US010792927B2

(12) United States Patent
Eto

(10) Patent No.: US 10,792,927 B2
(45) Date of Patent: Oct. 6, 2020

(54) LIQUID PROCESSING DEVICE

(71) Applicant: KYOCERA Document Solutions Inc., Osaka (JP)

(72) Inventor: Daisuke Eto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/580,805

(22) Filed: Sep. 24, 2019

(65) Prior Publication Data

US 2020/0094564 A1 Mar. 26, 2020

(30) Foreign Application Priority Data

Sep. 25, 2018 (JP) ..... 2018-178823

(51) Int. Cl.
*B41J 2/17* (2006.01)
*B41J 2/175* (2006.01)

(52) U.S. Cl.
CPC ..... *B41J 2/1752* (2013.01)

(58) Field of Classification Search
CPC ..... B41J 2/1752; B41J 2/17509; B41J 2/175; B41J 2/17513; B41J 2/17523; B41J 2/17553; B41J 2/1755
See application file for complete search history.

(56) References Cited

U.S. PATENT DOCUMENTS 6,007,191 A * 12/1999 Fujii ..... B41J 2/17513 347/87
2013/0135390 A1* 5/2013 Yamamoto ..... B41J 2/16517 347/42
2018/0264812 A1* 9/2018 Matsuura ..... B41J 2/1404
2019/0291447 A1* 9/2019 Sugiura ..... B41J 2/14209

FOREIGN PATENT DOCUMENTS

JP 2005-1307 A 1/2005

* cited by examiner

*Primary Examiner* — Kristal Feggins
(74) *Attorney, Agent, or Firm* — Stein IP, LLC

(57) ABSTRACT

A first retractable member is provided so as to be freely retractable with respect to the first location hole of a turning member in a state where the first retractable member makes contact with a fitting portion. The first retractable member turns the turning member based on a contact force with the fitting portion corresponding to advance and retreat with respect to the first location hole. The first retractable member moves a fourth engagement portion as the turning member is turned so as to change an engagement position with a third engagement portion, and thereby makes a head unit swing with the engagement position of a first engagement portion and a second engagement portion serving as a fulcrum point so as to adjust the position of the head unit in the fitting portion.

4 Claims, 30 Drawing Sheets

LIQUID PROCESSING DEVICE

INCORPORATION BY REFERENCE

This application is based upon and claims the benefit of priority from the corresponding Japanese Patent Application No. 2018-178823 filed on Sep. 25, 2018, the entire contents of which are incorporated herein by reference.

BACKGROUND

The present disclosure relates to a liquid processing device such as an inkjet printer which jets a liquid from a head unit to a workpiece so as to perform predetermined processing.

For example, in an inkjet printer, print processing is performed which jets a small amount of ink (liquid) from a head unit to a workpiece such as a sheet or a cloth. The head unit is normally installed in a carriage for print scanning. In a state where the workpiece is transported in a predetermined transport direction and where the carriage installing the head unit is reciprocated in a direction orthogonal to the transport direction, the ink is jetted from the head unit. In this way, characters and images are formed on the workpiece.

In order to reduce the occurrence of a print failure such as density unevenness or color displacement in an image formed on a workpiece, it is necessary to highly accurately locate a head unit with respect to a carriage so as to fix it. Technologies on a fixing mechanism which fixes the head unit with respect to the carriage as described above are conventionally proposed. For example, a head unit fitted to a carriage is pressed by the biasing force of a plate spring, the head unit is made to swing according to the turning of a movable location member and thus the position of the head unit with respect to the carriage is adjusted so as to be located.

Incidentally, an operation of adjusting the position of the head unit with respect to the carriage is performed by an operator. When as the fixing mechanism which fixes the head unit with respect to the carriage, the conventional technology is adopted, an operation of turning a lever portion of the movable location member in an up/down direction is performed so as to adjust the position of the head unit with respect to the carriage. In the adjustment of the position of the head unit with respect to the carriage as described above, it is difficult to find a relationship between the amount of turning of the movable location member and the amount of swinging of the head unit, with the result that it is disadvantageously difficult to appropriately adjust the position of the head unit.

SUMMARY

A liquid processing device according to an aspect of the present disclosure includes a head unit, a head holding member and a fixing mechanism. The head unit jets a liquid to a predetermined workpiece. The head holding member includes a fitting portion to which the head unit is fitted and holds the head unit in a state where the head unit is fitted to the fitting portion. The fixing mechanism locates, with respect to the fitting portion, the head unit which is moved to the fitting portion in a predetermined fitting direction so as to be fitted thereto and fixes the head unit. The fixing mechanism includes a turning member, a first position regulation portion, a second position regulation portion and a first retractable member. The turning member is arranged in the fitting portion so as to be able to turn about a predetermined turning shaft, and a first location hole along the fitting direction is provided in a position away from the turning shaft in a width direction of the head unit orthogonal to the fitting direction. The first position regulation portion includes a first engagement portion that is arranged in the head unit and a second engagement portion that is arranged in the fitting portion and that can engage with the first engagement portion. The first position regulation portion regulates the position of the head unit in the fitting portion in the fitting direction by engagement of the first engagement portion and the second engagement portion. The second position regulation portion includes a third engagement portion that is arranged in the head unit and a fourth engagement portion that is arranged in a position of the turning member away from the turning shaft in the fitting direction and that can engage with the third engagement portion. The second position regulation portion regulates the position of the head unit in the fitting portion in the width direction by engagement of the third engagement portion and the fourth engagement portion. The first retractable member s provided so as to be freely retractable with respect to the first location hole of the turning member in a state where the first retractable member makes contact with the fitting portion. The first retractable member turns the turning member based on a contact force with the fitting portion corresponding to advance and retreat with respect to the first location hole. The first retractable member moves the fourth engagement portion as the turning member is turned so as to change an engagement position with the third engagement portion, and thereby makes the head unit swing with the engagement position of the first engagement portion and the second engagement portion serving as a fulcrum point so as to adjust the position of the head unit in the fitting portion.

Further other objects of the present disclosure and specific advantages of the present disclosure will become more apparent from the description of an embodiment given below.

DETAILED DESCRIPTION

[Overall Configuration of Image Forming Apparatus]

Figure 1:
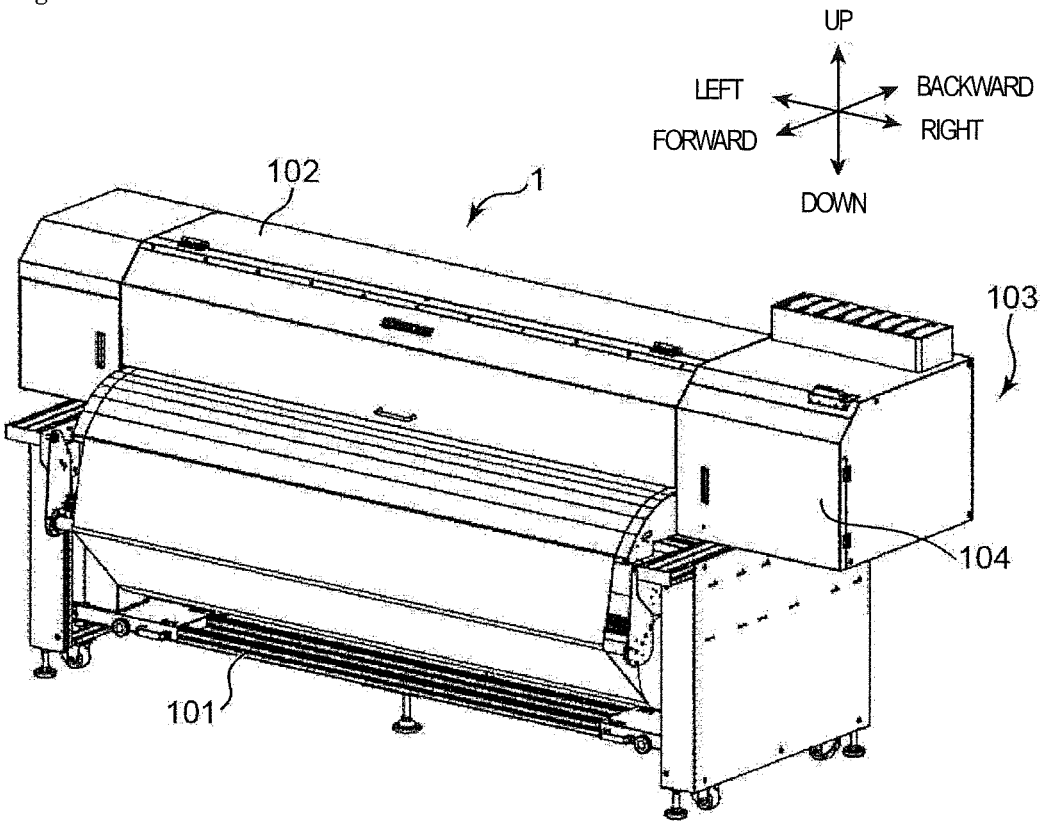
FIG. 1 is a perspective view showing the appearance of an image forming apparatus according to an embodiment of the present embodiment.
Figure 2:
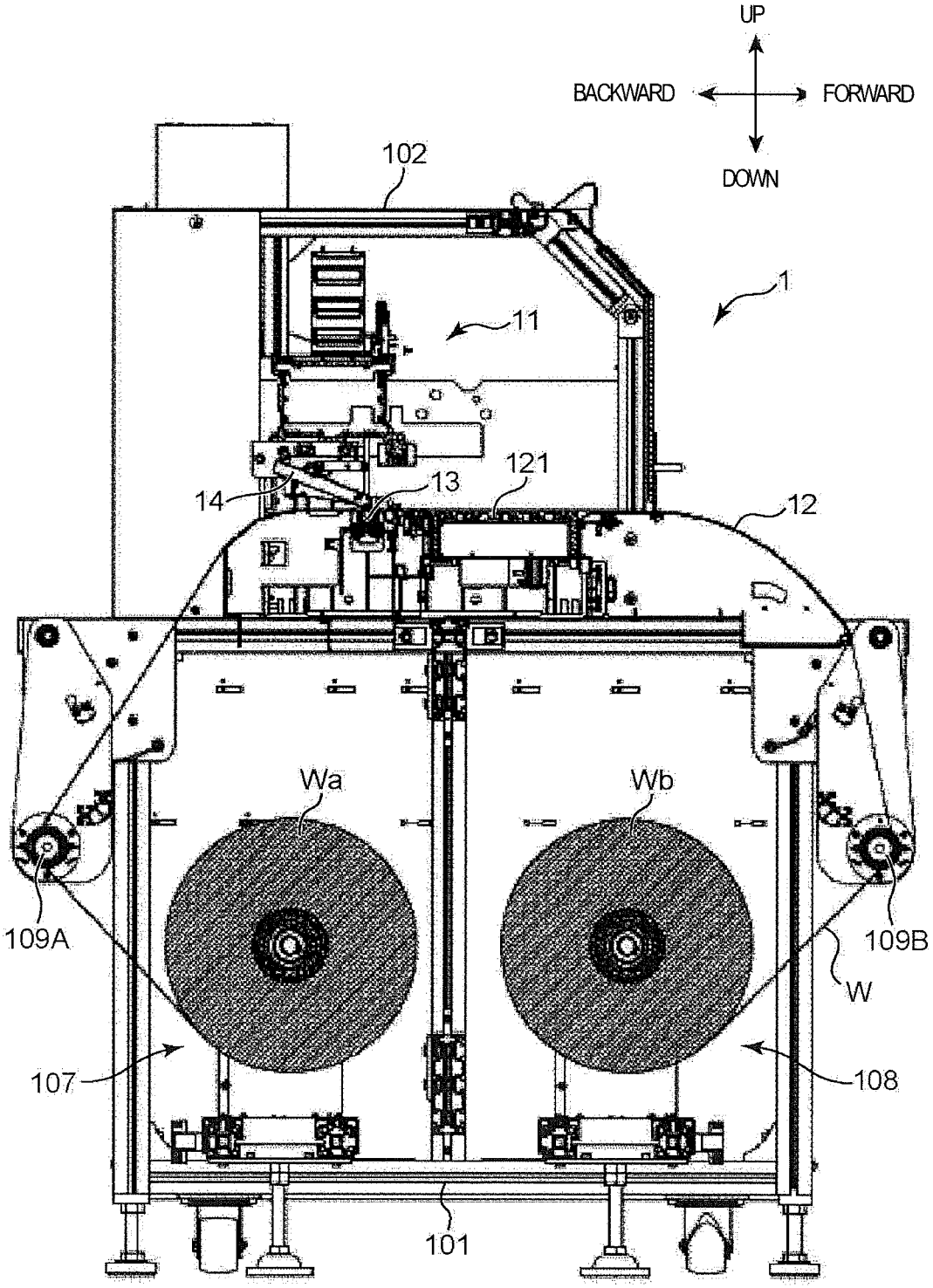
FIG. 2 is a cross-sectional view of the image forming apparatus.
Figure 3:
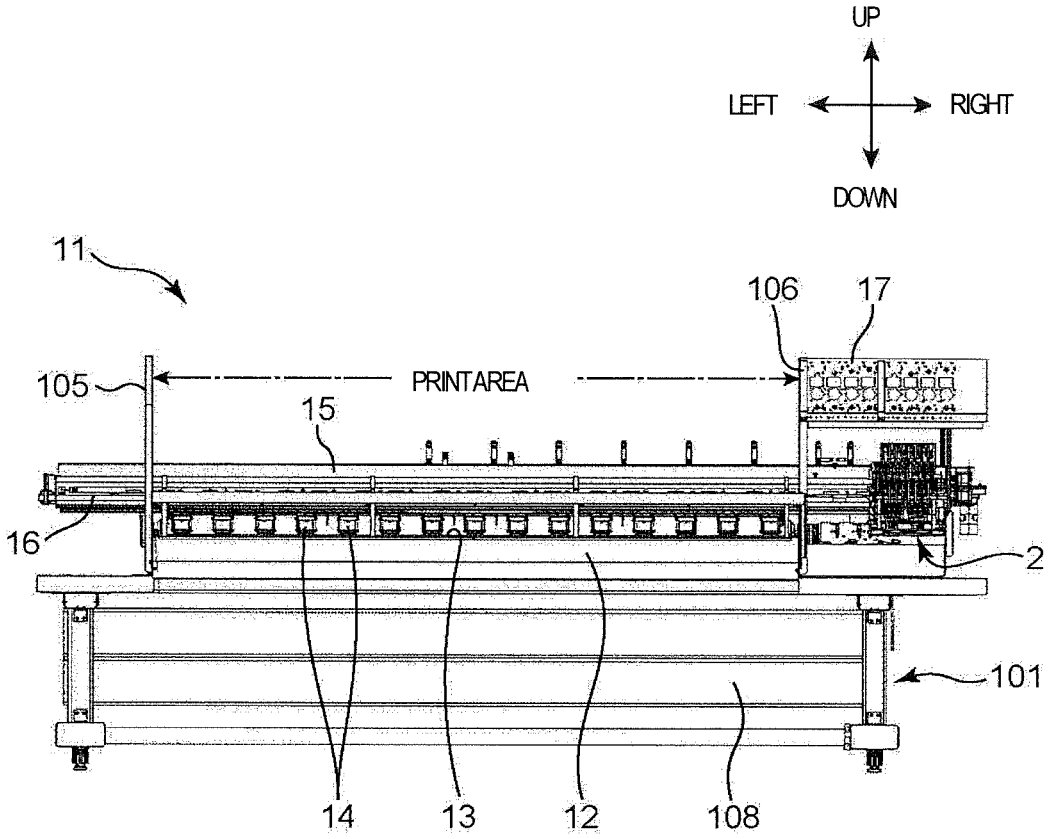
FIG. 3 is a front view of the image forming apparatus in a state where an outer cover is removed.
Figure 4:
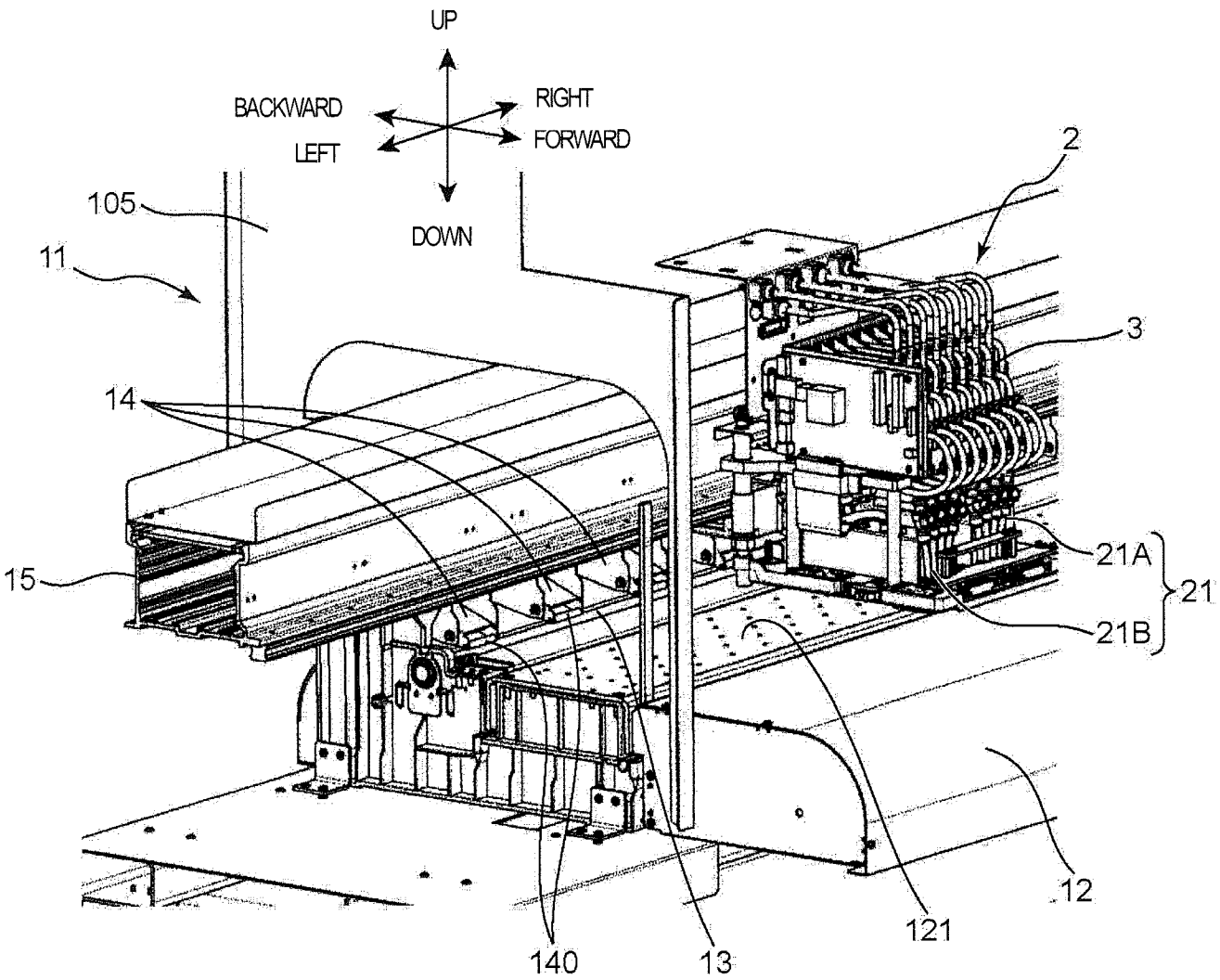
FIG. 4 is an enlarged perspective view showing part of the image forming apparatus in the state where the outer cover is removed.

An embodiment of the present disclosure will be described below with reference to drawings. A description will first be given of an image forming apparatus serving as an inkjet printer to which a liquid processing device according to the present disclosure is applied. FIG. 1 is a perspective view showing the appearance of the image forming apparatus 1 according to the embodiment of the present disclosure, and FIG. 2 is a cross-sectional view of the image forming apparatus 1. FIG. 3 is a front view of the image forming apparatus 1 in a state where an outer cover 102 is removed, and FIG. 4 is an enlarged perspective view showing part of the image forming apparatus 1 in the state where the outer cover 102 is removed. Although in FIGS. 1 to 4 and the subsequent figures, a forward/backward direction, a left/right direction and an up/down direction are indicated, they are intended for convenience of description and are not intended at all to limit the directions.

The image forming apparatus 1 performs print processing such as character printing and image printing by an inkjet method on various types of workpieces W such as paper sheets, resin sheets and cloth fabrics of various sizes. The image forming apparatus 1 is particularly suitable for print processing on a workpiece W having a large size and a long length. The image forming apparatus 1 includes: a base frame 101 on casters; and an apparatus main body 11 which is placed on the base frame 101 and which performs the print processing (image formation operation) described above.

The apparatus main body 11 includes a workpiece transport path 12, a transport roller 13, a plurality of pinch roller units 14 and a carriage 2.

The workpiece transport path 12 is a transport path that carries the workpiece W to which the print processing is performed into the apparatus main body 11 from the back side, that carries the workpiece W out from the front side and that is extended in the forward/backward direction.

The transport roller 13 is a roller which is extended in the left/right direction and which generates a drive force for intermittently feeding the workpiece W in the workpiece transport path 12. In other words, the transport roller 13 is rotated about a predetermined shaft center which is extended in the left/right direction and thereby transports the workpiece W in a forward direction (predetermined transport direction) such that the workpiece W is passed through an image formation position opposite a head unit 21 (image formation portion).

The pinch roller units 14 are arranged opposite the transport roller 13 from above, and include pinch rollers 140. The pinch rollers 140 form transport nip portions with the transport roller 13. A plurality of pinch roller units 14 are spaced a predetermined distance in the left/right direction along the transport roller 13.

In the carriage 2, a unit is installed which performs the print processing on the workpiece W. The carriage 2 is a moving member which can be reciprocated on the base frame 101 along the left/right direction (predetermined movement direction). On the upper side with respect to the base frame 101, a carriage guide 15 is arranged so as to be extended in the left/right direction, and includes a guide rail. The guide rail guides the reciprocation movement of the carriage 2. A timing belt 16 is assembled to the carriage guide 15 so as to be able to move rotatively in the left/right direction. The carriage 2 includes a fixing portion for the timing belt 16. The carriage 2 is moved in the left/right direction according to the forward or reverse rotative movement of the timing belt 16 while being guided by the guide rail.

The print processing described above is performed in a manner in which the transport roller 13 and the pinch roller units 14 intermittently feed the workpiece W, in which the carriage 2 is moved in the left/right direction while the workpiece W is being stopped and in which thus image printing scanning is performed on the workpiece W. In the workpiece transport path 12, below the passage route of the carriage 2, a platen 121 (FIGS. 2 and 4) which has the function of sucking the workpiece W is arranged. In other words, in the platen 121, the image formation position for the workpiece W is arranged. At the time of the print processing described above, in a state where the workpiece W is sucked to the platen 121, the carriage 2 performs the image printing scanning.

The apparatus main body 11 is covered with the outer cover 102. In a region on right side of the outer cover 102, a side station 103 is arranged. Within the side station 103, a stationary ink cartridge shelf 17 is accommodated that holds ink cartridges (unillustrated) in which inks (predetermined liquids) for the print processing are stored.

A front portion of the side station 103 is a carriage retraction area 104 which serves as a retraction space for the carriage 2. As shown in FIG. 3, on the base frame 101, a left frame 105 and a right frame 106 are provided so as to stand with a distance corresponding to the workpiece transport path 12 left in the left/right direction. An area between these left and right frames 105 and 106 is set to a print area in which the print processing can be performed. The carriage guide 15 has a lateral width longer than the print area, and thus the carriage 2 can be moved to the outside of the print area on the right side. When the print processing is not performed, the carriage 2 is retracted into the carriage retraction area 104.

In the back side of the base frame 101, a feed-out portion 107 is provided that accommodates a feed-out roll Wa serving as a winding member for the workpiece W on which the print processing is performed. The feed-out portion 107 feeds out the workpiece W while providing a predetermined tension to the workpiece W with a tension roller 109A.

In the front side of the base frame 101, a winding portion 108 is provided that accommodates a winding roll Wb serving as a winding member for the workpiece W after the print processing. The winding portion 108 includes an unillustrated drive source for driving and rotating the winding shaft of the winding roll Wb so as to wind the workpiece W while providing a predetermined tension to the workpiece W with a tension roller 109B.

As shown in FIG. 4, in the carriage 2, head units 21 which jet inks (liquids) to the workpiece W so as to form an image and liquid supply units 3 which supply the inks from the ink cartridge to the head units 21 are installed.

FIG. 4 shows an example where two head units 21 formed with a first head unit 21A and a second head unit 21B and eight liquid supply units 3 are installed in the carriage 2. In other words, for one of the head units 21, in order to supply the individual inks of cyan, magenta, yellow and black, four liquid supply units 3 are provided.

The carriage 2 is reciprocated along the carriage guide 15 in the left/right direction. A configuration may be adopted in which inks of different colors are charged into the individual liquid supply units 3 and in which thus the inks of the maximum eight colors are jetted from the two head units 21 formed with the first head unit 21A and the second head unit 21B.

[Configuration of Carriage]

Figure 5:
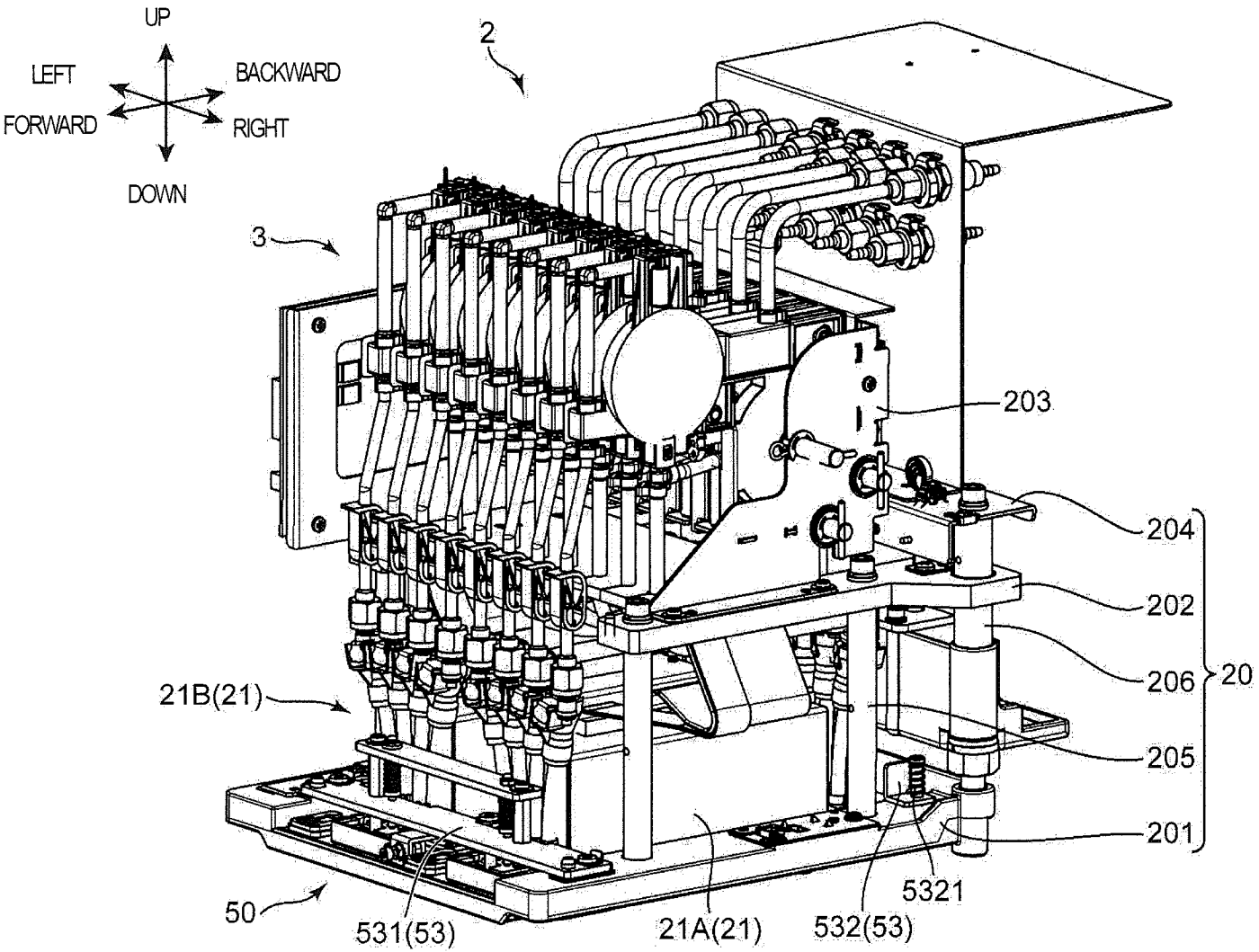
FIG. 5 is an overall perspective view of a carriage included in the image forming apparatus.
Figure 6:
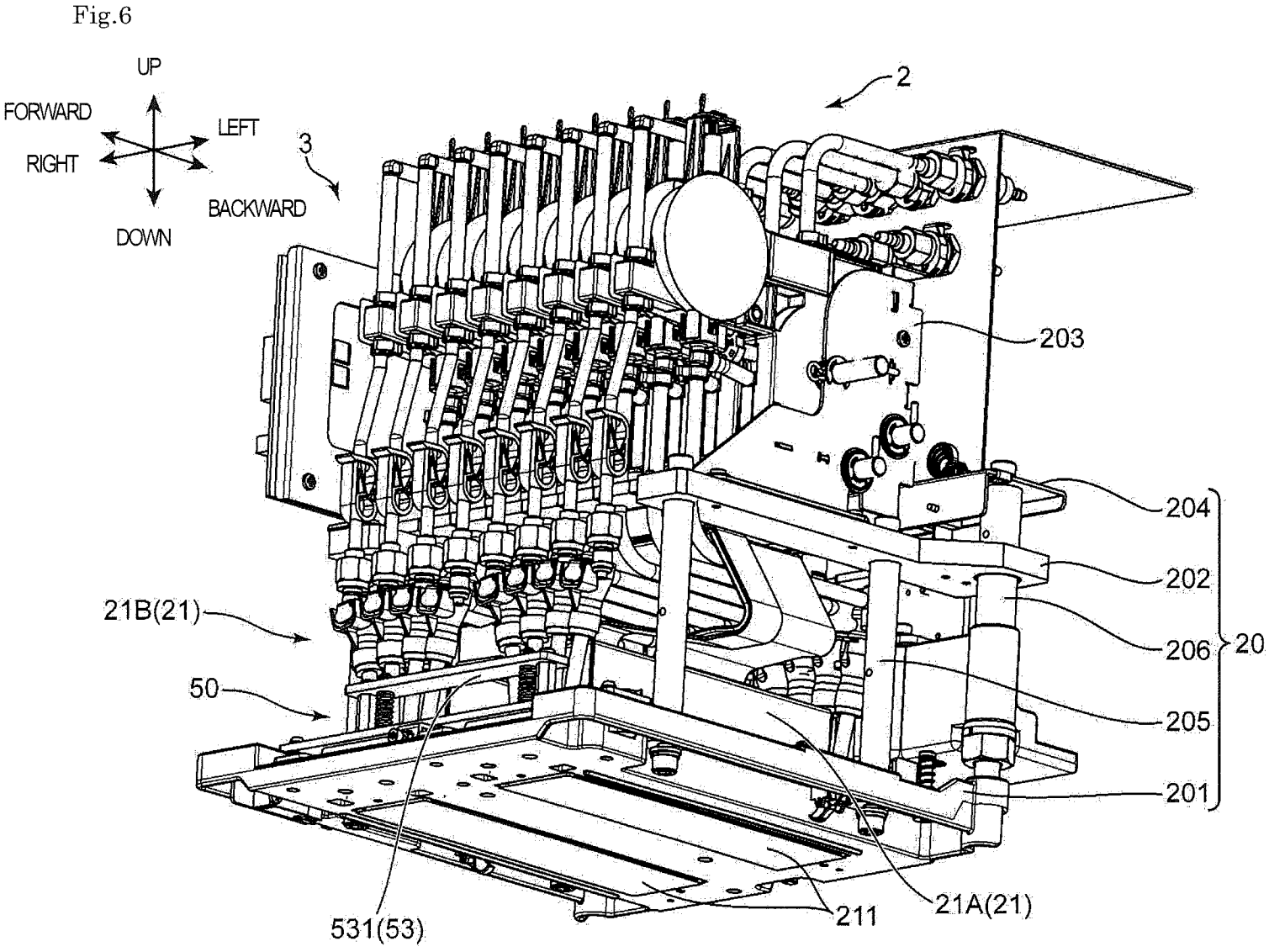
FIG. 6 is an overall perspective view of the carriage.
Figure 7:
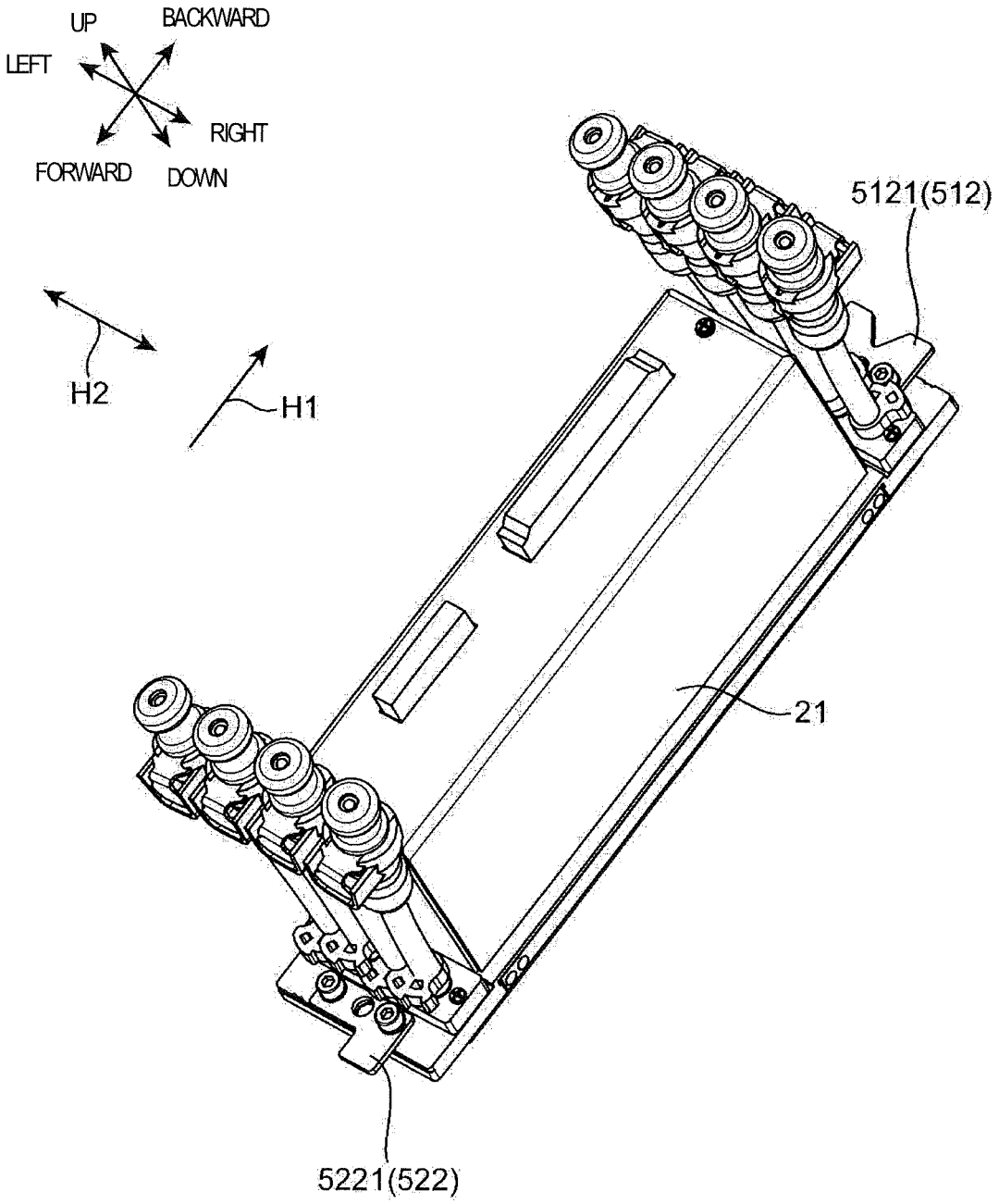
FIG. 7 is a perspective view of a head unit installed in the carriage.
Figure 8:
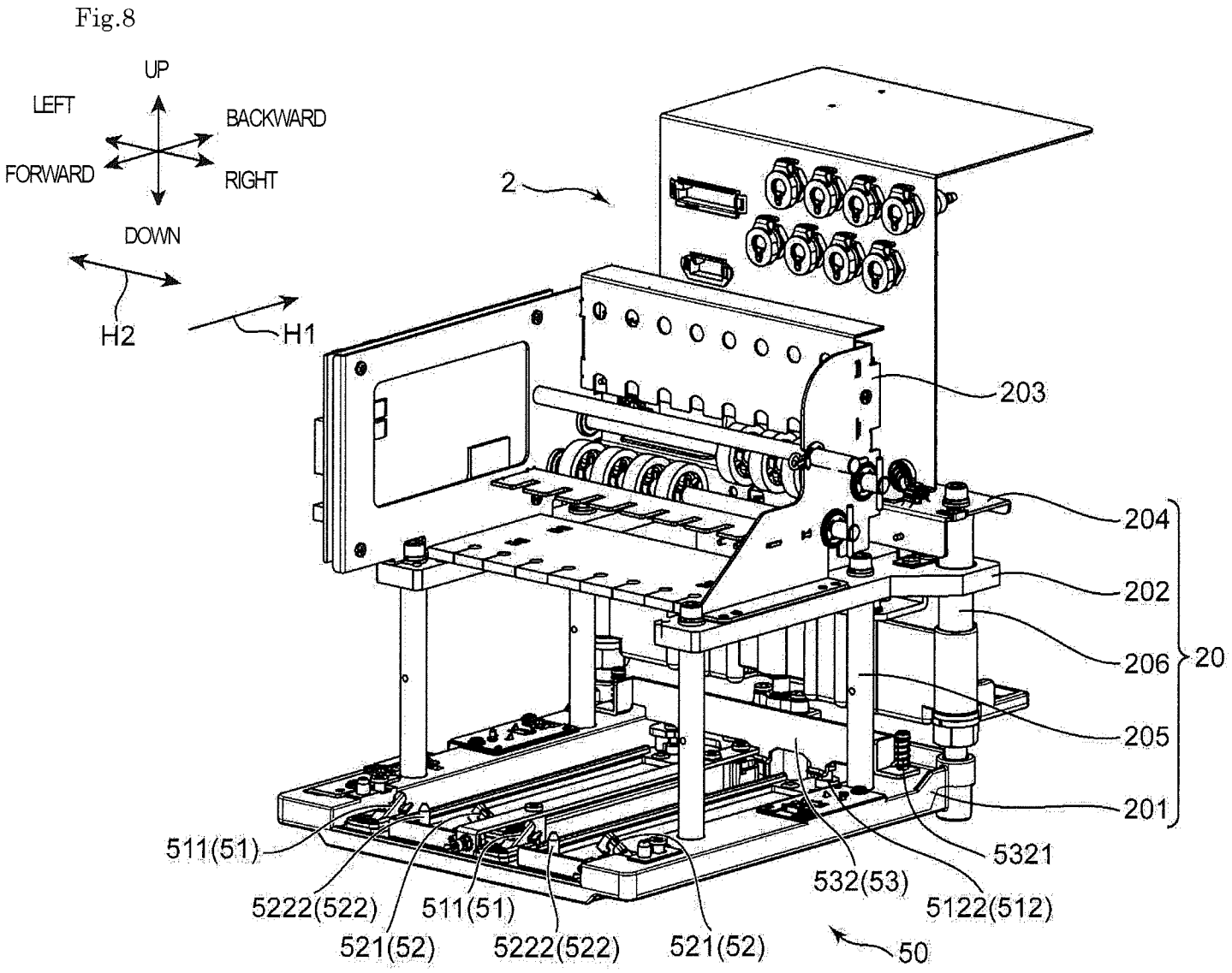
FIG. 8 is a perspective view of the carriage in a state where the head units are removed.
Figure 9:
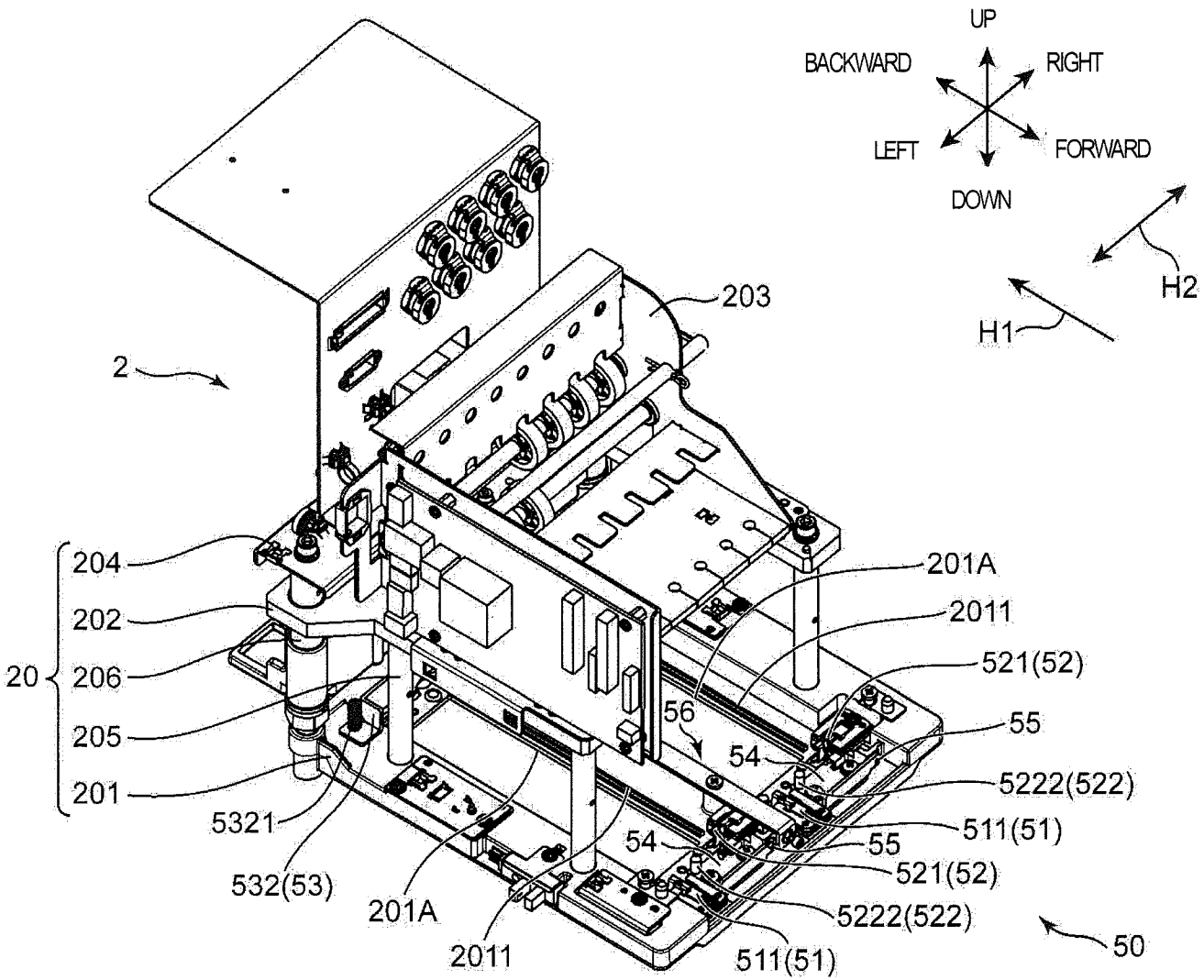
FIG. 9 is a perspective view of the carriage in the state where the head units are removed.

FIGS. 5 and 6 are overall perspective views of the carriage 2 included in the image forming apparatus 1. FIG. 7 is a perspective view of the head unit 21 installed in the carriage 2. FIGS. 8 and 9 are perspective views of the carriage 2 in a state where the head unit 21 is removed.

The carriage 2 includes a carriage frame 20 serving as a head holding member which holds the head units 21. The carriage frame 20 includes a lower frame 201, an upper frame 202, a rack 203 and a back frame 204. The lower frame 201 is located lowest. The upper frame 202 is arranged above the lower frame 201 with a distance left. The rack 203 is assembled to the upper surface of the upper frame 202. The back frame 204 is attached to the back surface of the upper frame 202.

The lower frame 201 and the upper frame 202 are coupled with coupling columns 205 which are extended in the up/down direction. In the back frame 204, an unillustrated ball screw mechanism is installed, and a nut portion which is driven with the ball screw thereof is attached to the lower frame 201. In the back frame 204, guide columns 206 are provided which are extended in the up/down direction. By the drive of the ball screw mechanism described above, the coupling member of the lower frame 201 and the upper frame 202 can be moved in the up/down direction while being guided by the guide columns 206. In other words, the main body portion of the carriage 2 can be moved in the up/down direction with respect to the back frame 204.

The lower frame 201 forms, in the carriage frame 20, a fitting portion to which the head units 21 are fitted. In the lower frame 201, opening portions 201A (FIG. 9) are formed which are extended in the forward/backward direction. The ink jetting surfaces 211 (FIG. 6) of the head units 21 are fitted to the lower frame 201 so as to be exposed from the opening portions 201A. The main body portion of the carriage 2 can be moved in the up/down direction as described above, and thus the height positions of the head units 21 with respect to the workpiece W in the up/down direction can be adjusted. On the upper frame 202, the liquid supply units 3 are installed. The eight liquid supply units 3 are supported on the upper frame 202 so as to be aligned in the left/right direction within the rack 203. In the back frame 204, a fixing portion and the like for the timing belt 16 are incorporated.

As shown in FIG. 7, the head unit 21 is substantially formed in the shape of a rectangular parallelepiped, and is fitted to the lower frame 201 such that the longitudinal direction thereof orthogonal to the width direction H2 thereof is parallel to the forward/backward direction. The fitting of the head unit 21 to the lower frame 201 is performed by an operator. An operation of moving the head unit 21 in a fitting direction H1 extending backward from the front side of the lower frame 201 is performed by the operator, and thus the head unit 21 is fitted to the lower frame 201. The fitting direction H1 in which the head unit 21 is fitted to the lower frame 201 is parallel to the transport direction of the workpiece W. The head unit 21 fitted to the lower frame 201 is located with a fixing mechanism 50 with respect to the lower frame 201 so as to be fixed.

[Configuration of Fixing Mechanism]

The fixing mechanism 50 is a mechanism which locates, with respect to the lower frame 201, the head unit 21 that is moved to the lower frame 201 in the fitting direction H1 so as to be fitted thereto, and which fixes the head unit 21. The fixing mechanism 50 includes a first location portion 51, a second location portion 52 and a third location portion 53. The first location portion 51 locates the head unit 21 in the fitting direction H1 on the horizontal surface with respect to the lower frame 201. The second location portion 52 locates the head unit 21 in the width direction H2 orthogonal to the fitting direction H1 on the horizontal surface. The third location portion 53 locates the head unit 21 in the up/down direction (vertical direction) orthogonal to both the fitting direction H1 and the width direction H2. The width direction H2 of the head unit 21 is parallel to the movement direction (left/right direction) of the carriage 2.

In the present embodiment, the first location portion 51 and the second location portion 52 are provided so as to correspond to each of the two head units 21 which are formed with the first head unit 21A and the second head unit 21B provided adjacent to the first head unit 21A in the width direction H2.

The third location portion 53 locates both the two head units 21 in the up/down direction with respect to the lower frame 201. The first location portions 51 which are provided so as to individually correspond to the two head units 21 have the same structure, and the second location portions 52 also have the same structure.

The fixing mechanism 50 further includes turning members 54 and first screw members 55 for adjusting the positions of the head units 21 in the lower frame 201 and an adjustment portion 56 for adjusting the position of the second head unit 21B with respect to the first head unit 21A in the fitting direction H1. The fixing members 54 and the first screw members 55 are provided so as to individually correspond to the first head unit 21A and the second head unit 21B. The fixing members 54 and the first screw members 55 which are provided so as to individually correspond to the two head units 21 have the same structure. The adjustment portion 56 is provided so as to correspond to only the second head unit 21B.

<Configurations of First Location Portion, Second Location Portion and Third Location Portion>

The first location portion 51 includes a first pressing member 511 and a first position regulation portion 512. The first pressing member 511 is a member which presses the head unit 21 fitted to the lower frame 201 in the fitting direction H1 (direction extending from forward to backward). More specifically, the first pressing member 511 is arranged on the front side of the opening portion 201A in an end portion (front end portion) of the lower frame 201 on the upstream side in the fitting direction H1, and presses, in the fitting direction H1, a front end portion serving as one end portion of the head unit 21 fitted to the lower frame 201 in the longitudinal direction. The details of the configuration of the first pressing member 511 will be described later.

The first position regulation portion 512 regulates the position of the head unit 21 pressed by the first pressing member 511 in the lower frame 201 in the fitting direction H1. The first position regulation portion 512 includes a first engagement portion 5121 (FIG. 7) and a second engagement portion 5122 (FIG. 8). The first engagement portion 5121 is arranged in a downstream end portion (back end portion) of the head unit 21 in the fitting direction H1. The second engagement portion 5122 is arranged in a back end portion of the lower frame 201, and can engage with the first engagement portion 5121. The first engagement portion 5121 and the second engagement portion 5122 engage with each other, and thus it is possible to regulate the position of the head unit 21 pressed by the first pressing member 511 in the lower frame 201 in the fitting direction H1. In this way, the head unit 21 is located in the lower frame 201 in the fitting direction H1.

The second location portion 52 includes a second pressing member 521 and a second position regulation portion 522. The second pressing member 521 is a member which presses the head unit 21 fitted to the lower frame 201 to one side (left side) of the width direction H2. More specifically, the second pressing member 521 is arranged on the front side and the right side of the opening portion 201A in an end portion (front end portion) of the lower frame 201 on the upstream side in the fitting direction H1, and presses a front end portion serving as one end portion of the head unit 21 fitted to the lower frame 201 in the longitudinal direction thereof to the one side (left side) of the width direction H2. The details of the configuration of the second pressing member 521 will be described later.

The second position regulation portion 522 regulates the position of the head unit 21 pressed by the second pressing member 521 in the lower frame 201 in the width direction H2. The second position regulation portion 522 includes a third engagement portion 5221 (FIG. 7) and a fourth engagement portion 5222 (FIG. 8). The third engagement portion 5221 is arranged in an upstream end portion (front end portion) of the head unit 21 in the fitting direction H1. The fourth engagement portion 5222 is arranged in a front end portion of the lower frame 201, and can engage with the third engagement portion 5221. The third engagement portion 5221 and the fourth engagement portion 5222 engage with each other, and thus it is possible to regulate the position of the head unit 21 pressed by the second pressing member 521 in the lower frame 201 in the width direction H2. In this way, the head unit 21 is located in the lower frame 201 in the width direction H2.

The third location portion 53 includes a third pressing member 531 (FIGS. 5 and 6) and a fourth pressing member 532 (FIGS. 8 and 9). The third pressing member 531 is a member which is extended in the width direction H2 (the left/right direction) of the head unit 21 and which presses downward an upstream end portion (front end portion, that is, a portion where the third engagement portion 5221 is arranged) of the head unit 21 fitted to the lower frame 201 in the fitting direction H1. The third pressing member 531 is fixed to the front end portion of the lower frame 201 in a state where the upstream end portion of the head unit 21 in the fitting direction H1 is pressed downward.

The fourth pressing member 532 is a member which is extended in the width direction H2 (the left/right direction) of the head unit 21 and which presses downward a downstream end portion (back end portion, that is, a portion where the first engagement portion 5121 is arranged) of the head unit 21 fitted to the lower frame 201 in the fitting direction H1. The fourth pressing member 532 is fixed, through a spring member 5321, to the back end portion of the lower frame 201 so as to freely swing in the up/down direction in a state where the downstream end portion of the head unit 21 in the fitting direction H1 is pressed downward. The third pressing member 531 and the fourth pressing member 532 press the head unit 21 downward so as to be able to regulate the position of the head unit 21 in the lower frame 201 in the up/down direction. In this way, the head unit 21 is located in the lower frame 201 in the up/down direction.

(Detailed Configurations of First Pressing Member and Second Pressing Member)

The first pressing member 511 of the first location portion 51 and the second pressing member 521 of the second location portion 52 have the same structure except that the directions of arrangements with respect to the lower frame 201 are different. The configurations of the first pressing member 511 and the second pressing member 521 will be described in detail with reference to FIGS. 10 to 16.

Figure 10:
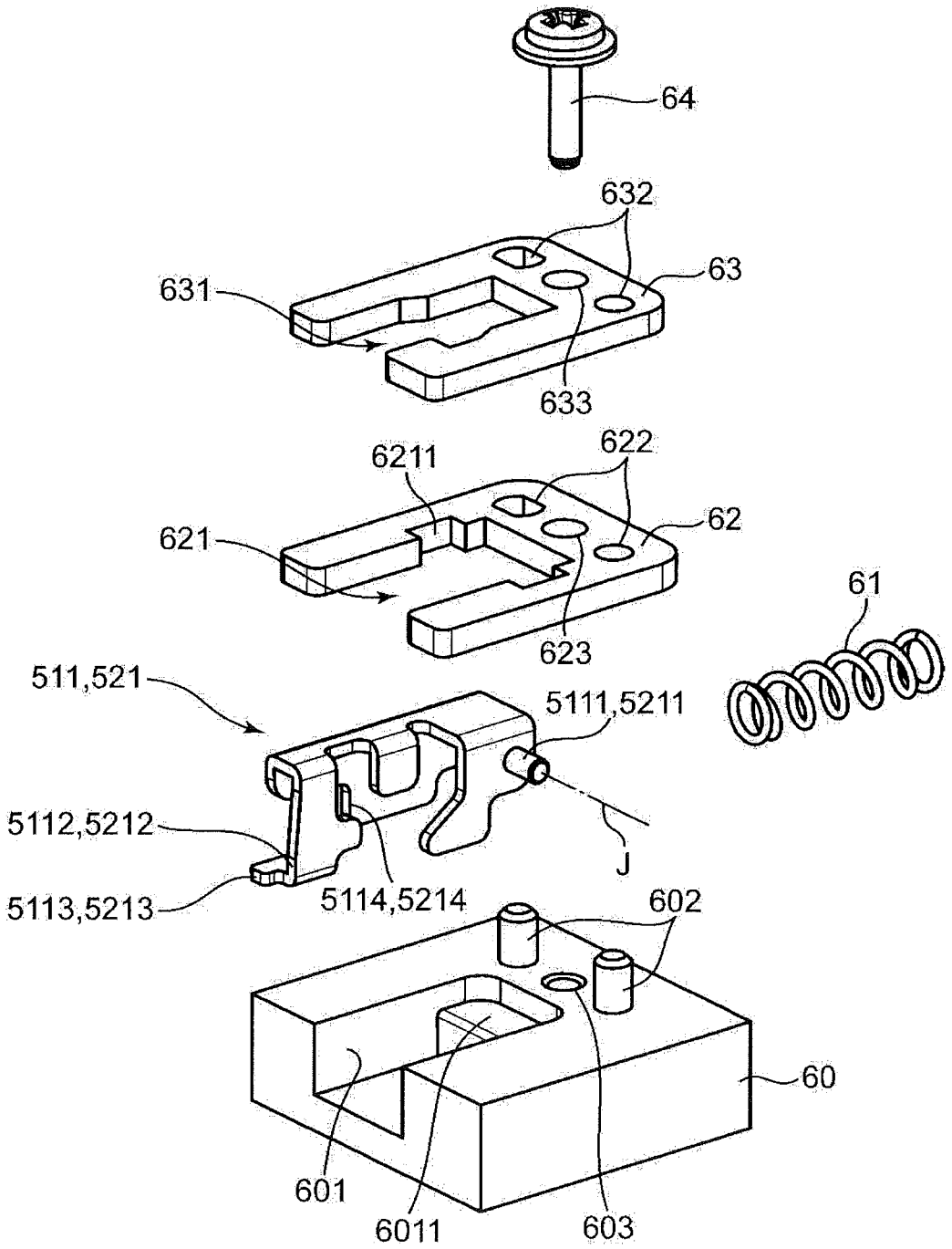
FIG. 10 is an exploded perspective view of pressing members arranged in a lower frame of a carriage frame and individual members holding the pressing members in a fixing mechanism included in the image forming apparatus.
Figure 11:
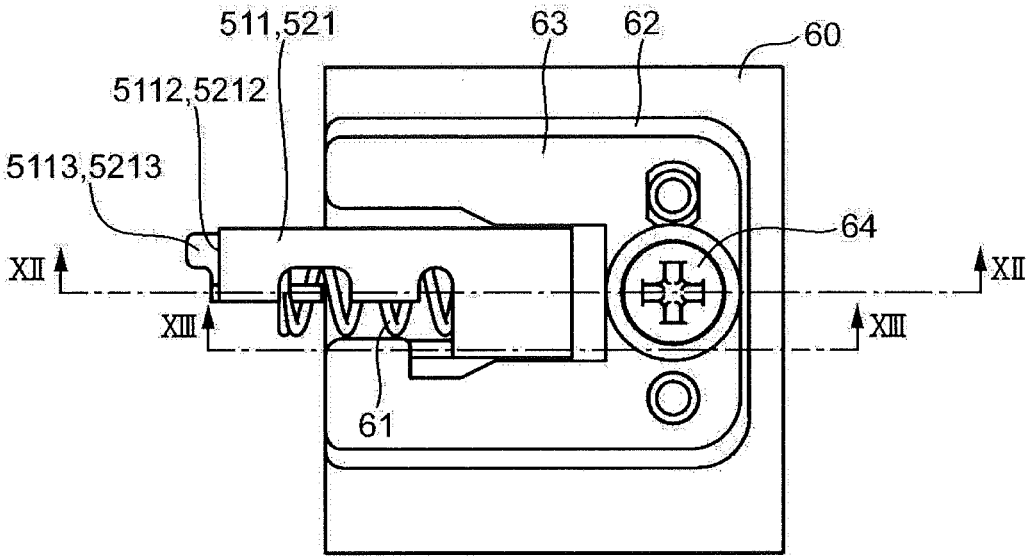
FIG. 11 is a plan view when the pressing members in a first posture are seen from above.
Figure 12:
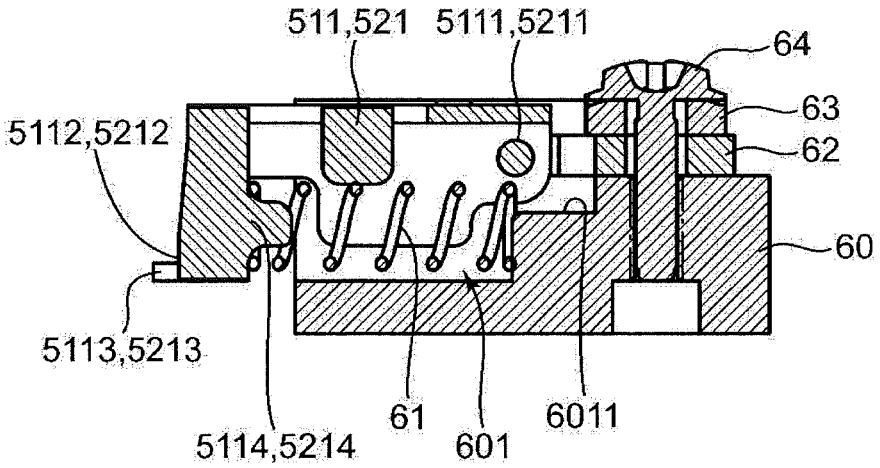
FIG. 12 is a cross-sectional view taken along cut line XII-XII of FIG. 11.
Figure 13:
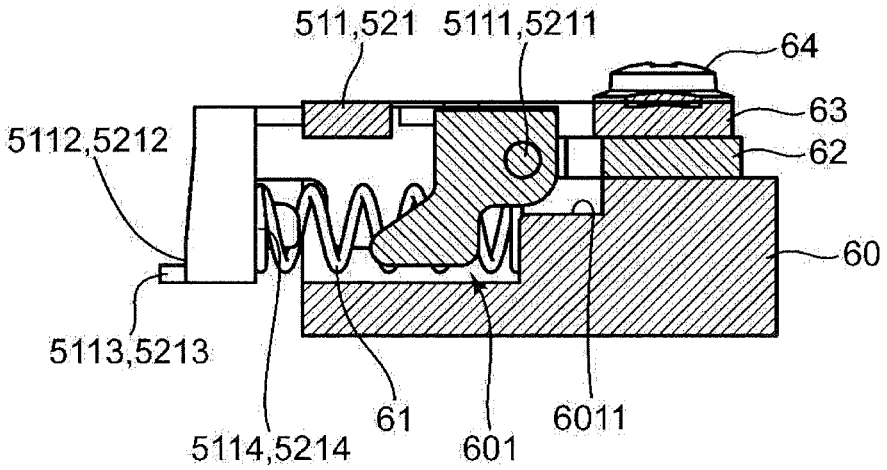
FIG. 13 is a cross-sectional view taken along cut line XIII-XIII of FIG. 11.
Figure 14:
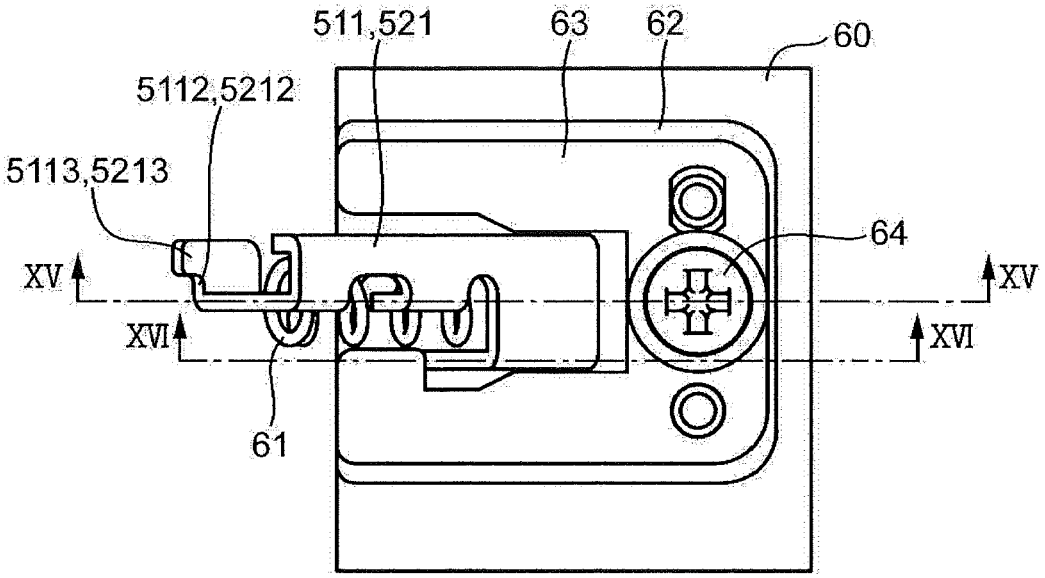
FIG. 14 is a plan view when the pressing members in a second posture are seen from above.
Figure 15:
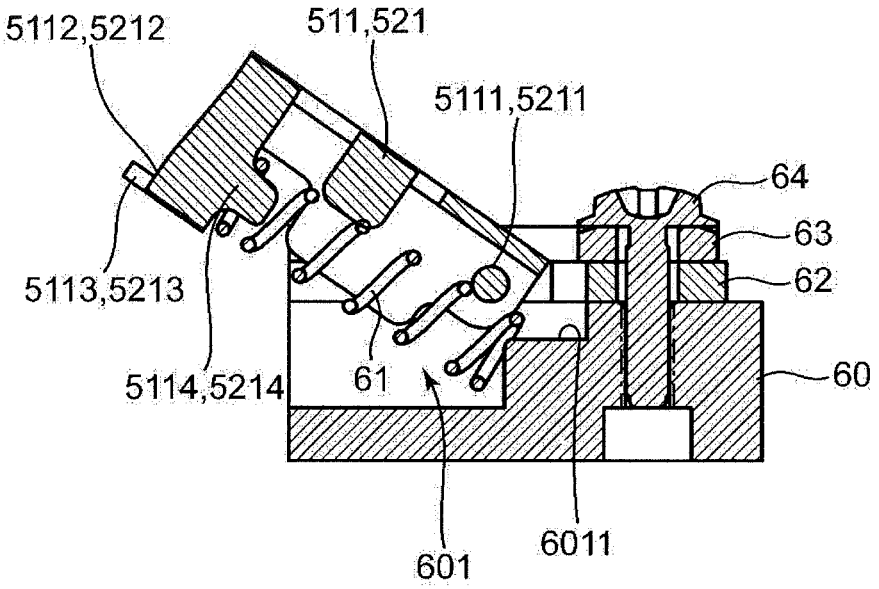
FIG. 15 is a cross-sectional view taken along cut line XV-XV of FIG. 14.
Figure 16:
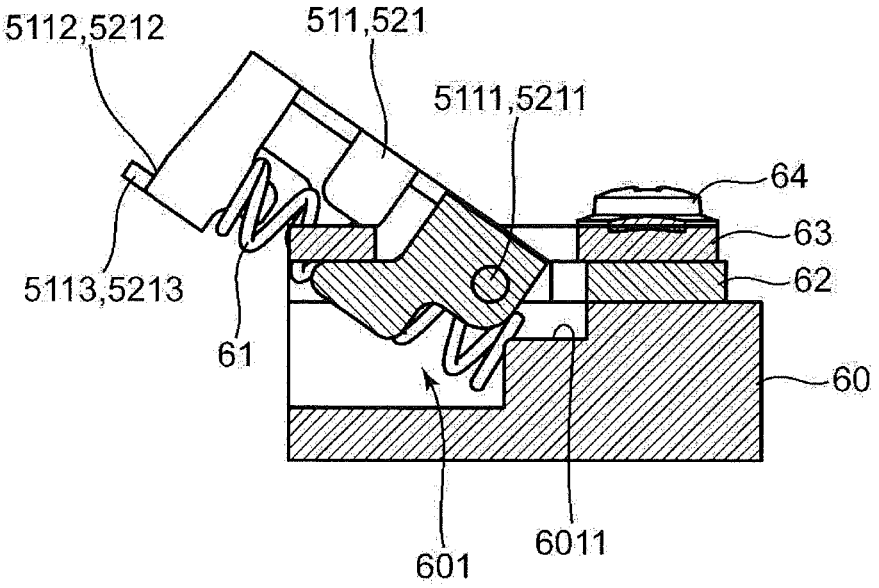
FIG. 16 is a cross-sectional view taken along cut line XVI-XVI of FIG. 14.

FIG. 10 is an exploded perspective view of the first pressing member 511 and the second pressing member 521 and individual members holding the first pressing member 511 and the second pressing member 521. FIG. 11 is a plan view when the first and second pressing members 511 and 521 in a first posture are seen from above. FIG. 12 is a cross-sectional view taken along cut line XII-XII of FIG. 11, and FIG. 13 is a cross-sectional view taken along cut line XIII-XIII of FIG. 11. FIG. 14 is a plan view when the first and second pressing members 511 and 521 in a second posture are seen from above. FIG. 15 is a cross-sectional view taken along cut line XV-XV of FIG. 14, and FIG. 16 is a cross-sectional view taken along cut line XVI-XVI of FIG. 14.

Each of the first pressing member 511 and the second pressing member 521 is a member which has a predetermined length. The first pressing member 511 is arranged in the lower frame 201 such that the longitudinal direction thereof is parallel to the fitting direction H1. The second pressing member 521 is arranged in the lower frame 201 such that the longitudinal direction thereof is parallel to the width direction H2.

Each of the first pressing member 511 and the second pressing member 521 includes a shaft portion 5111, 5211 at one end portion in the longitudinal direction, and also includes a pressing portion 5112, 5212 which is arranged at the other end portion (tip end portion) opposite to the shaft portion 5111, 5211 in the longitudinal direction and which presses the head unit 21. Each of the first pressing member 511 and the second pressing member 521 further includes a protrusion part 5113, 5213 which is protruded outward from the pressing portion 5112, 5212 and a locking portion 5114, 5214 which locks one end portion of a coil spring member 61 (biasing member).

The shaft portion 5111 of the first pressing member 511 is extended along the width direction H2 of the head unit 21. The first pressing member 511 is freely turned about the shaft center J of the shaft portion 5111 such that its posture can be changed between the first posture (posture shown in FIGS. 11 to 13) which is horizontal and the second posture (posture shown in FIGS. 14 to 16) which is inclined with respect to the first posture with its tip end raised. Furthermore, the first pressing member 511 freely swings in a direction (the fitting direction H1) in which the first pressing member 511 presses the head unit 21 according to the displacement of the compression or elongation of the coil spring member 61 whose one end portion is locked to the locking portion 5214.

The first pressing member 511 is in the second posture when the head unit 21 is not fitted to the lower frame 201. In a state where the first pressing member 511 is in the second posture as described above, the coil spring member 61 is elongated most.

On the other hand, when the head unit 21 is fitted to the lower frame 201, the first pressing member 511 is in the first posture. In a state where the first pressing member 511 is in the first posture as described above, the coil spring member 61 is compressed most. In the first posture, the first pressing member 511 presses, through pressing portion 5112, the head unit 21 in the fitting direction H1 by the biasing force of the compressed coil spring member 61. In the head unit 21 pressed by the first pressing member 511 in the first posture, the lower end edge of a front end portion serving as one end portion in the longitudinal direction thereof makes contact with the protrusion part 5113 of the first pressing member 511.

As shown in FIGS. 12 and 13, in a state where the first pressing member 511 presses the head unit 21, that is, in a state where the first pressing member 511 is in the first posture, the center of the locking portion 5114 which receives the biasing force of the coil spring member 61 is located on the downward side with respect to the shaft portion 5111 serving as a turning fulcrum point. Furthermore, the pressing portion 5112 is located on the downward side with respect to the locking portion 5114. In other words, in a state where the first pressing member 511 is in the first posture, the shaft portion 5111, the locking portion 5114 and the pressing portion 5112 are arranged downward in this order so as to be aligned. The head unit 21 is pressed in the fitting direction H1 through the pressing portion 5112 in the arrangement state described above, and thus it is possible to reduce a movement in which the first pressing member 511 in the first posture is turned upward about the shaft portion 5111 so as to change the posture to the second posture. Hence, it is possible to reduce the raising of the head unit 21 pressed by the first pressing member 511 to the upward side.

The shaft portion 5211 of the second pressing member 521 is extended along the fitting direction H1 of the head unit 21. The second pressing member 521 is freely turned about the shaft center J of the shaft portion 5211 such that its posture can be changed between the first posture (posture shown in FIGS. 11 to 13) which is horizontal and the second posture (posture shown in FIGS. 14 to 16) which is inclined with respect to the first posture with its tip end raised. Furthermore, the second pressing member 521 freely swings in a direction (one side of the width direction H2) in which the second pressing member 521 presses the head unit 21 according to the displacement of the compression or elongation of the coil spring member 61 whose one end portion is locked to the locking portion 5214.

The second pressing member 521 is in the second posture when the head unit 21 is not fitted to the lower frame 201. In a state where the second pressing member 521 is in the second posture as described above, the coil spring member 61 is elongated most. On the other hand, when the head unit 21 is fitted to the lower frame 201, the second pressing member 521 is in the first posture. In a state where the second pressing member 521 is in the first posture as described above, the coil spring member 61 is compressed most. In the first posture, the second pressing member 521 presses, through the pressing portion 5212, the head unit 21 to one side of the width direction H2 by the biasing force of the compressed coil spring member 61. In the head unit 21 pressed by the second pressing member 521 in the first posture, the lower end edge of a front end portion serving as one end portion in the longitudinal direction thereof makes contact with the protrusion part 5213 of the second pressing member 521.

As shown in FIGS. 12 and 13, in a state where the second pressing member 521 presses the head unit 21, that is, in a state where the second pressing member 521 is in the first posture, the center of the locking portion 5214 which receives the biasing force of the coil spring member 61 is located on the downward side with respect to the shaft portion 5211 serving as a turning fulcrum point, and furthermore, the pressing portion 5212 is located on the downward side with respect to the locking portion 5214. In other words, in a state where the second pressing member 521 is in the first posture, the shaft portion 5211, the locking portion 5214 and the pressing portion 5212 are arranged downward in this order so as to be aligned. The head unit 21 is pressed to one side of the width direction H2 through the pressing portion 5212 in the arrangement state described above, and thus it is possible to reduce a movement in which the second pressing member 521 in the first posture is turned upward about the shaft portion 5211 so as to change the posture to the second posture. Hence, it is possible to reduce the raising of the head unit 21 pressed by the second pressing member 521 to the upward side.

Each of the first pressing member 511 and the second pressing member 521 is arranged in the lower frame 201 in a state where it is held in a holder 60. The holder 60 includes an accommodation concave portion 601 which accommodates the first pressing member 511 or the second pressing member 521, and a step portion 6011 is formed within the accommodation concave portion 601. In a state where each of the first pressing member 511 and the second pressing member 521 is accommodated within the accommodation concave portion 601, one end portion of the coil spring member 61 is locked to the locking portion 5114, 5214, and the other end portion makes contact with the step portion 6011.

Each of the first pressing member 511 and the second pressing member 521 is prevented from being removed by a first anti-removal member 62 and a second anti-removal member 63 in a state where it is accommodated within the accommodation concave portion 601, and is thereby held in the holder 60.

The first anti-removal member 62 includes a cutout portion 621. The cutout portion 621 is formed so as to allow the first pressing member 511 or the second pressing member 521 accommodated within the accommodation concave portion 601 to change the posture between the first posture and the second posture. In the cutout portion 621, a shaft portion cutout portion 6211 is formed in which the shaft portion 5111, 5211 of the first pressing member 511 or the second pressing member 521 accommodated within the accommodation concave portion 601 is arranged. The first anti-removal member 62 includes pin insertion holes 622 and a screw insertion hole 623. The protrusion pins 602 of the holder 60 are inserted through the pin insertion holes 622. A screw member 64 is inserted through the screw insertion hole 623. The first anti-removal member 62 is placed on the holder 60 such that the protrusion pins 602 are inserted through the pin insertion holes 622. Here, the screw member 64 in a state where the screw member 64 is inserted through the screw insertion hole 623 is inserted into the screw hole 603 of the holder 60 so as to be screwed to the holder 60.

The second anti-removal member 63 includes a cutout portion 631. The cutout portion 631 is formed so as to allow the first pressing member 511 or the second pressing member 521 accommodated within the accommodation concave portion 601 to change the posture between the first posture and the second posture. As with the first anti-removal member 62, the second anti-removal member 63 includes pin insertion holes 632 and a screw insertion hole 633. The protrusion pins 602 of the holder 60 are inserted through the pin insertion holes 632. The screw member 64 is inserted through the screw insertion hole 633. The second anti-removal member 63 is overlaid on the first anti-removal member 62 on the holder 60 such that the protrusion pins 602 are inserted through the pin insertion holes 632. Here, the screw member 64 in a state where the screw member 64 is inserted through the screw insertion hole 633 is inserted into the screw hole 603 of the holder 60, and thus the second anti-removal member 63 is screwed to the holder 60 on the first anti-removal member 62.

As described previously, in the image forming apparatus 1 according to the present embodiment, the head unit 21 is moved in the predetermined fitting direction H1 so as to be fitted to the lower frame 201. The head unit 21 fitted to the lower frame 201 is pressed by the first pressing member 511 in the fitting direction H1 so as to be located in the fitting direction H1, and is pressed by the second pressing member 521 to one side of the width direction H2 so as to be located in the width direction H2. In this way, the head unit 21 is fixed in a state where the head unit 21 is appropriately located in the lower frame 201.

Here, each of the first pressing member 511 and the second pressing member 521 is freely turned so as to be able to change the posture between the first posture and the second posture which is inclined with its tip end raised. Each of the first pressing member 511 and the second pressing member 521 is arranged in the lower frame 201 so as to freely swing in the direction in which it presses the head unit 21, and presses the head unit 21 while being in the first posture. Each of the first pressing member 511 and the second pressing member 521 freely swings in the direction in which it presses the head unit 21, and thereby can press, in the first posture, the head unit 21 with an appropriate pressing force. Each of the first pressing member 511 and the second pressing member 521 is in the first posture when pressing the head unit 21 whereas when it is in the second posture, the pressing of the head unit 21 is released. Hence, when the head unit 21 is fitted to the lower frame 201 and the operation of moving the head unit 21 to the lower frame 201 in the fitting direction H1 is performed, each of the first pressing member 511 and the second pressing member 521 is brought into the second posture, and thus the head unit 21 can be prevented from receiving frictional resistance from each of the pressing members 511 and 521. This results in excellent operability when the head unit 21 is fitted to the lower frame 201.

(Relationship Between Operation of Fitting Head Unit and Operation of Turning Pressing Member)

As described previously, the fitting of the head unit 21 to the lower frame 201 is performed by the operator. A relationship between an operation of fitting the head unit 21 to the lower frame 201 and an operation of turning the first pressing member 511 and the second pressing member 521 will be described with reference to FIGS. 17 to 23.

Figure 17:
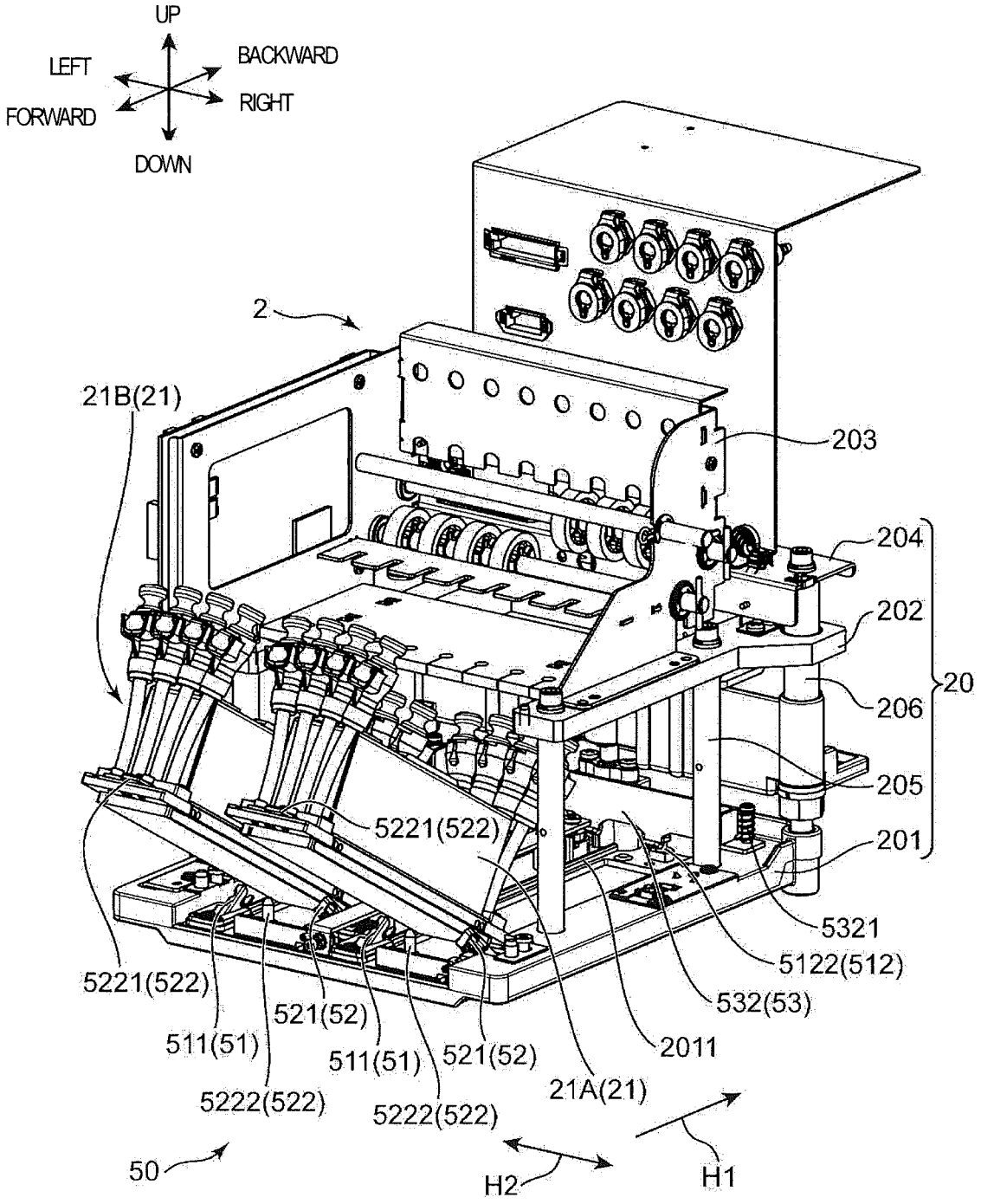
FIG. 17 is a perspective view of the carriage when a first operation is performed at the time of fitting of the head units to the lower frame.
Figure 18:
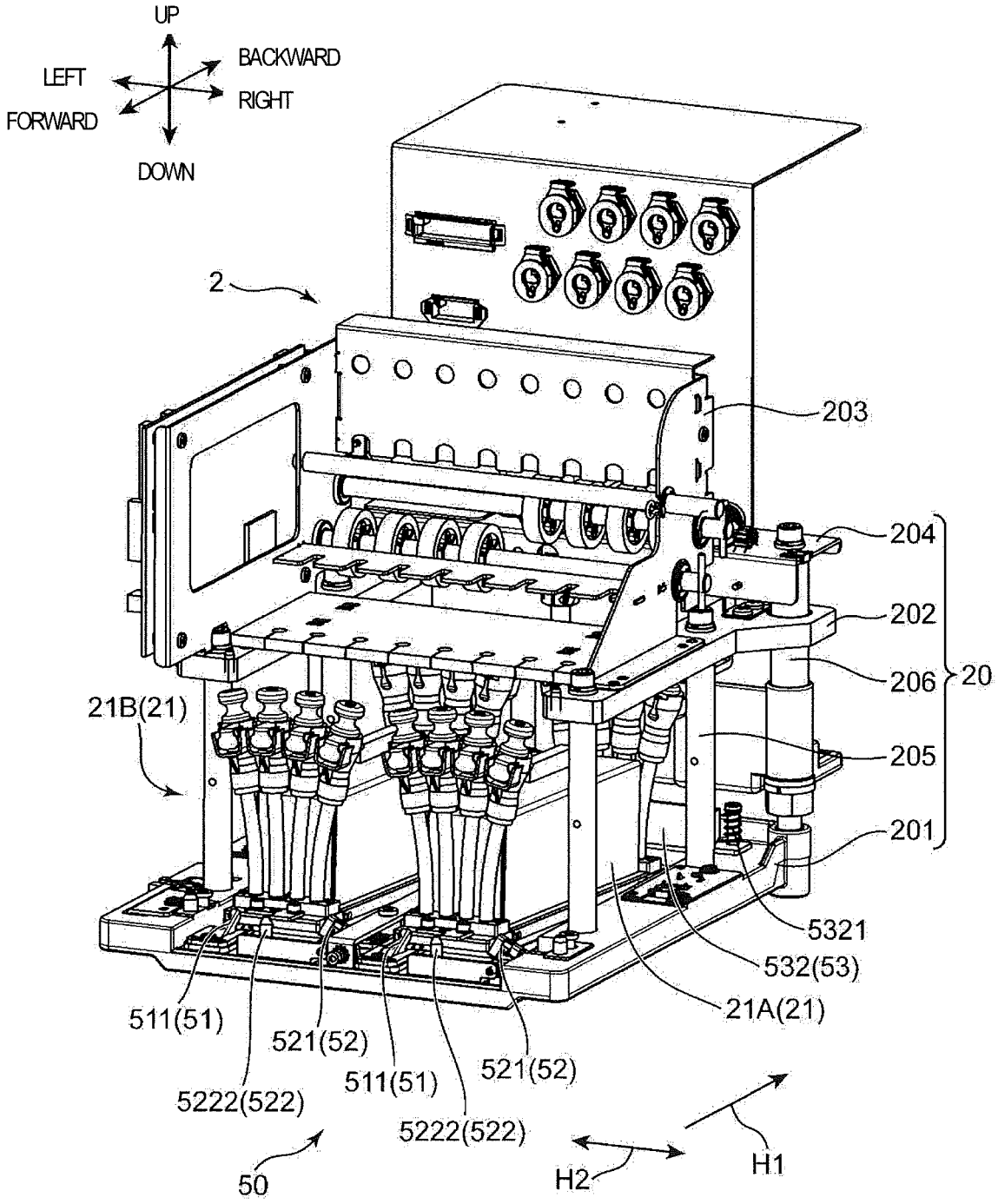
FIG. 18 is a perspective view of the carriage when the first operation is performed at the time of fitting of the head units to the lower frame.
Figure 19:
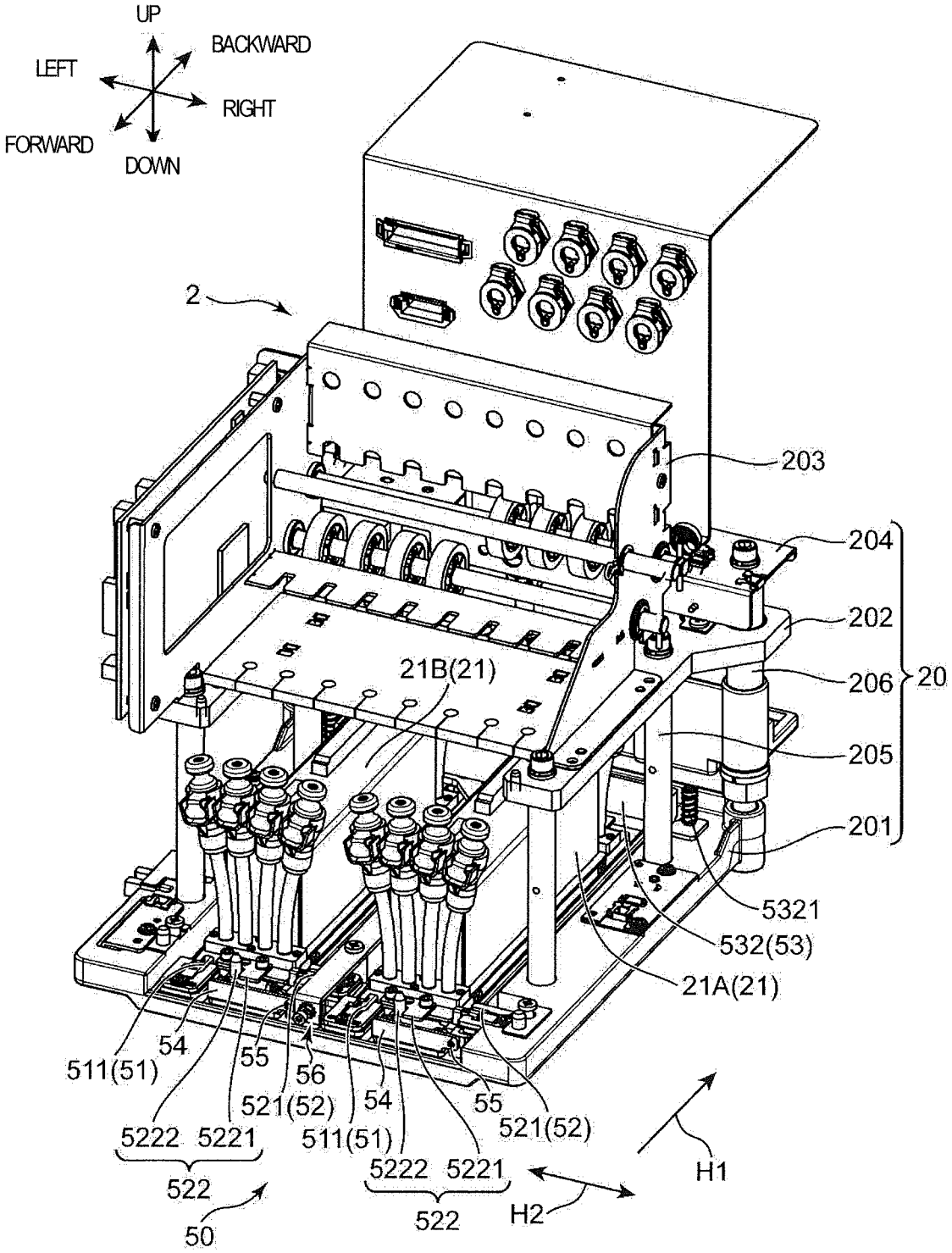
FIG. 19 is a perspective view of the carriage showing a state where the head units are fitted to the lower frame when a second operation is performed at the time of fitting of the head units to the lower frame.
Figure 20:
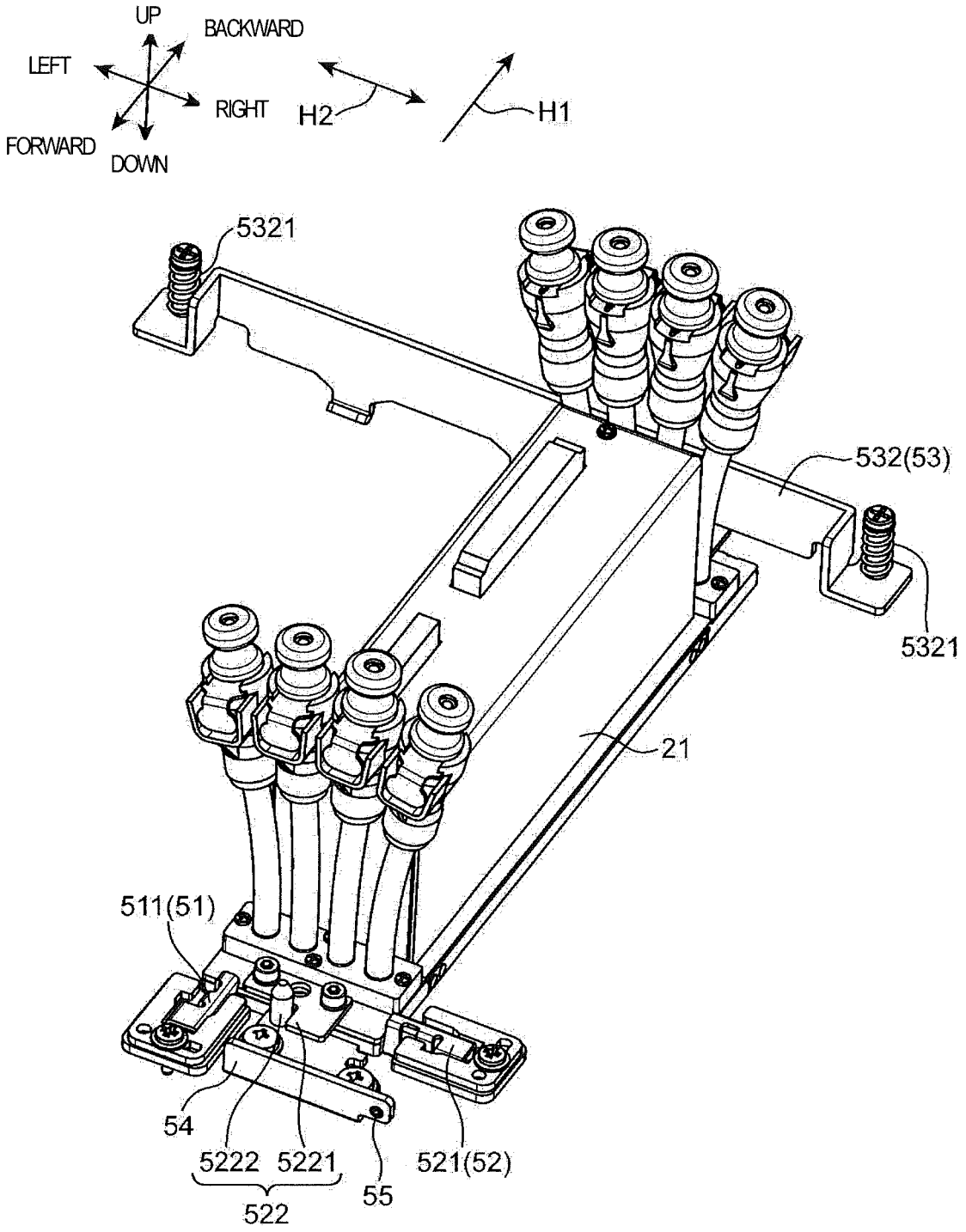
FIG. 20 is a perspective view showing a state where the head unit is located with the fixing mechanism so as to be fixed in a state where the head unit is fitted to the lower frame.
Figure 21:
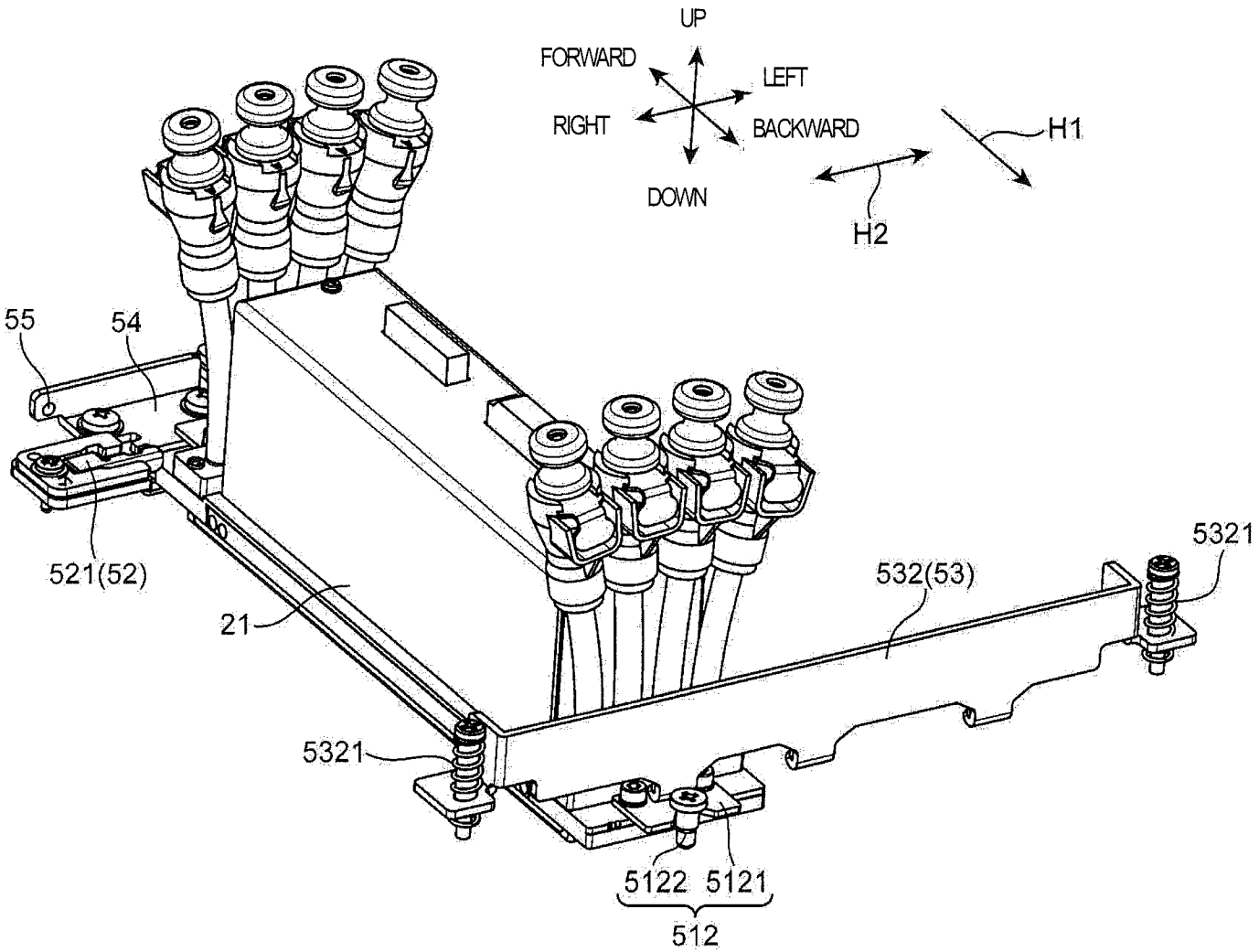
FIG. 21 is a perspective view showing the state where the head unit is located with the fixing mechanism so as to be fixed in the state where the head unit is fitted to the lower frame.
Figure 22:
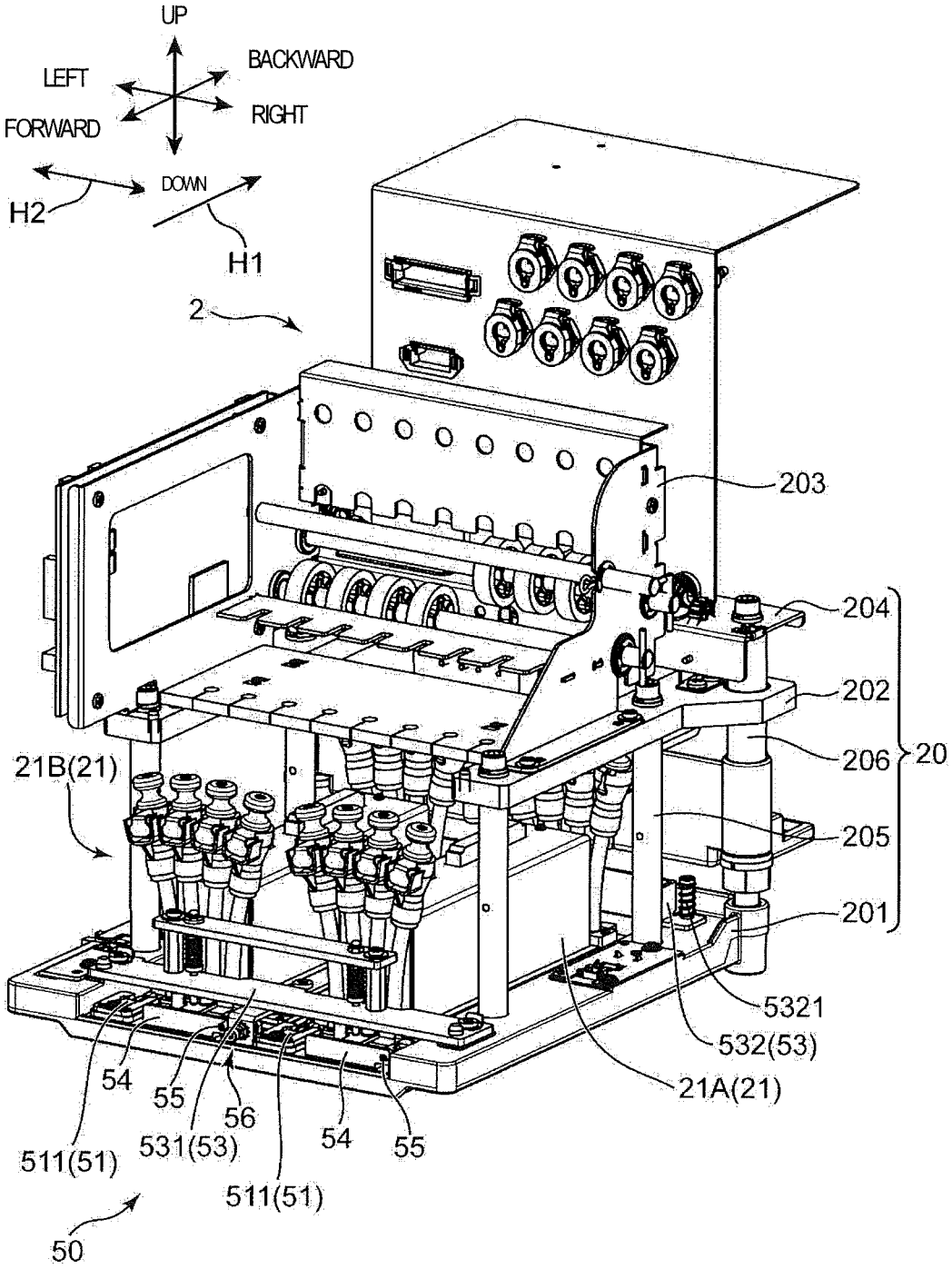
FIG. 22 is a perspective view of the carriage showing a state where the head units fitted to the lower frame are located with a third location portion of the fixing mechanism.
Figure 23:
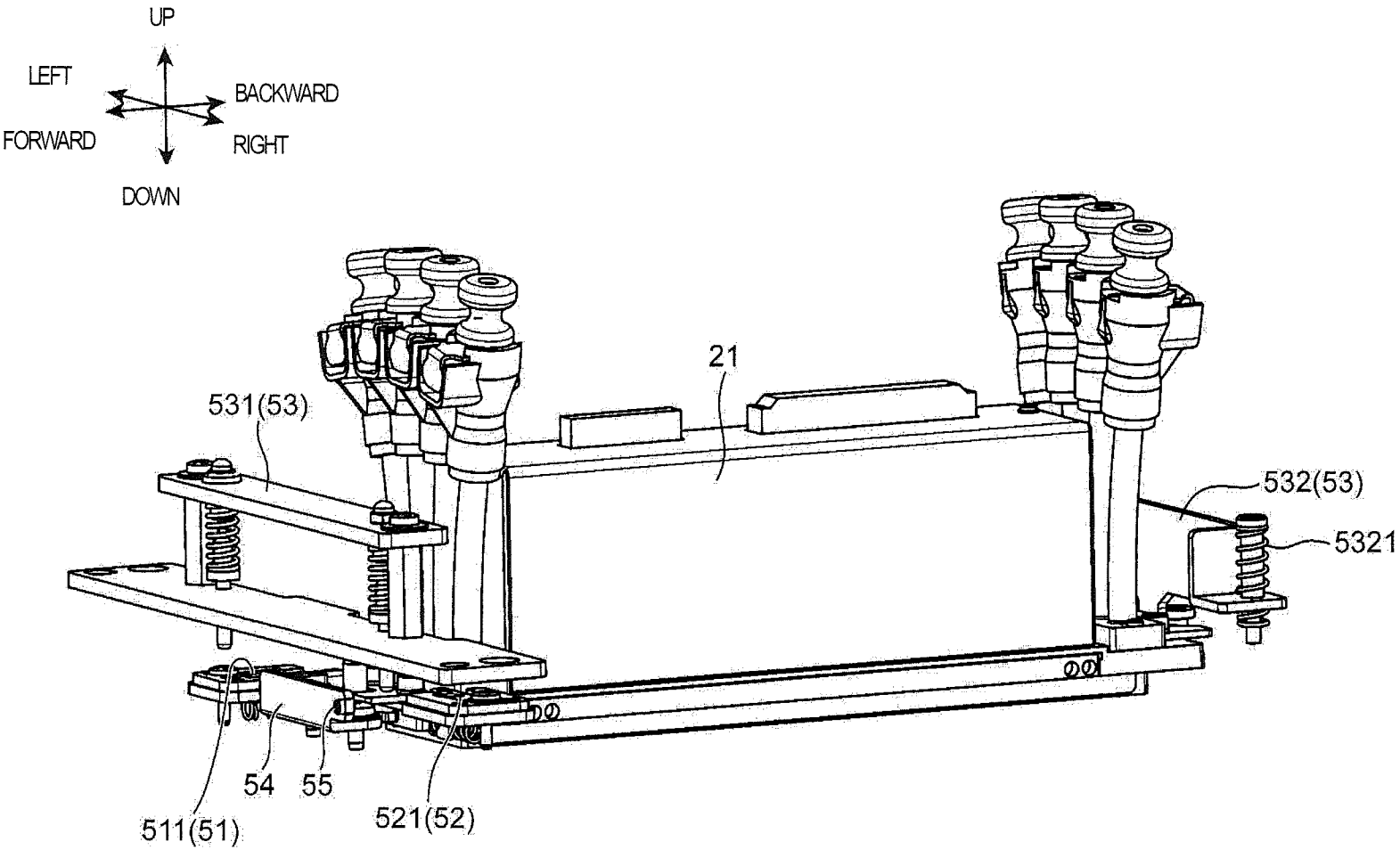
FIG. 23 is a perspective view showing a state where the head unit fitted to the lower frame is located with the third location portion of the fixing mechanism.

FIGS. 17 and 18 are perspective views of the carriage 2 when a first operation is performed at the time of fitting of the head units 21 to the lower frame 201. FIG. 19 is a perspective view of the carriage 2 showing a state where the head units 21 are fitted to the lower frame 201 when a second operation is performed at the time of fitting of the head units 21 to the lower frame 201. FIGS. 20 and 21 are perspective views showing a state where the head unit 201 is located with the fixing mechanism 50 so as to be fixed in a state where the head unit 21 is fitted to the lower frame 201. FIG. 22 is a perspective view of the carriage 2 showing a state where the head units 21 fitted to the lower frame 201 are located with the third pressing member 531 of the third location portion 53. FIG. 23 is a perspective view showing a state where the head unit 21 fitted to the lower frame 201 is located with the third pressing member 531 of the third location portion 53.

The head unit 21 is fitted to the lower frame 201 by the first operation and the second operation of the operator. The first operation is an operation performed by the operator when the head unit 21 is fitted to the lower frame 201, and is the operation of bringing the downstream end portion of the head unit 21 in the fitting direction H1 into contact with the lower frame 201 and moving the head unit 21 in the fitting direction H1 in an inclined posture in which the upstream end portion in the fitting direction H1 is separated upward from the lower frame 201 (see FIGS. 17 and 18). The second operation is an operation performed by the operator immediately after the first operation, and is the operation of pressing, downward toward the lower frame 201, the upstream end portion of the head unit 21 in the fitting direction H1 after being moved in the fitting direction H1 (see FIG. 19).

As shown in FIGS. 17 and 18, when the first operation of moving the head unit 21 to the lower frame 201 in the fitting direction H1 at the time of fitting of the head unit 21 to the lower frame 201 is performed, each of the first pressing member 511 and the second pressing member 521 is in the second posture in which the pressing of the head unit 21 is released. In this way, in the first operation at the time of fitting of the head unit 21 to the lower frame 201, the head unit 21 can be prevented from receiving frictional resistance from each of the pressing members 511 and 521, with the result that the operability of the first operation is excellent.

As shown in FIG. 19, as the second operation is performed in a state where the lower end edge of the front end portion serving as one end portion in the longitudinal direction of the head unit 21 makes contact with the protrusion part 5213, each of the first pressing member 511 and the second pressing member 521 is turned downward about the shaft portion 5111, 5211. In this way, each of the first pressing member 511 and the second pressing member 521 changes the posture from the second posture to the first posture, swings in the first posture in the direction in which it presses the head unit 21 and thereby can press the head unit 21 with an appropriate pressing force.

As described above, each of the first pressing member 511 and the second pressing member 521 is arranged in the end portion (front end portion) of the lower frame 201 on the upstream side in the filling direction H1. In this way, when the head unit 21 is moved in the filling direction H1 in the first operation at the time of fitting of the head unit 21 to the lower frame 201, the first pressing member 511 and the second pressing member 521 are prevented from interfering with the movement of the head unit 21. Hence, the operability of the first operation is more excellent.

In the first position regulation portion 512 of the first location portion 51, the first operation is performed at the time of fitting of the head unit 21 to the lower frame 201, and thus the first engagement portion 5121 and the second engagement portion 5122 engage with each other. The second operation is performed on the head unit 21 in a state where the first engagement portion 5121 and the second engagement portion 5122 engage with each other, and thus each of the first pressing member 511 and the second pressing member 521 is turned about the shaft portion 5111, 5211 so as to change the posture from the second posture to the first posture. When the second posture is performed immediately after the first operation, the first engagement portion 5121 and the second engagement portion 5122 are in a state where they engage with each other, and thus part of the engagement of the first engagement portion 5121 and the second engagement portion 5122 is used as a fulcrum point, with the result that it is possible to perform the second operation of pressing downward the upstream end portion of the head unit 21 in the fitting direction H1. Furthermore, by the second operation described above, the first pressing member 511 and the second pressing member 521 can be changed in posture from the second posture to the first posture in which the head unit 21 is pressed.

As shown in FIGS. 9 and 17, the lower frame 201 includes a guide portion 2011 which is provided in a peripheral portion of the opening portions 201A so as to be extended along the fitting direction H1 of the head unit 21. The guide portion 2011 guides the movement of the head unit 21 in the fitting direction H1 when the first operation is performed at the time of fitting of the head unit 21 to the lower frame 201. In this way, the operability of the first operation is more excellent.

<Configurations of Turning Member and First Screw Member>

Figure 24:
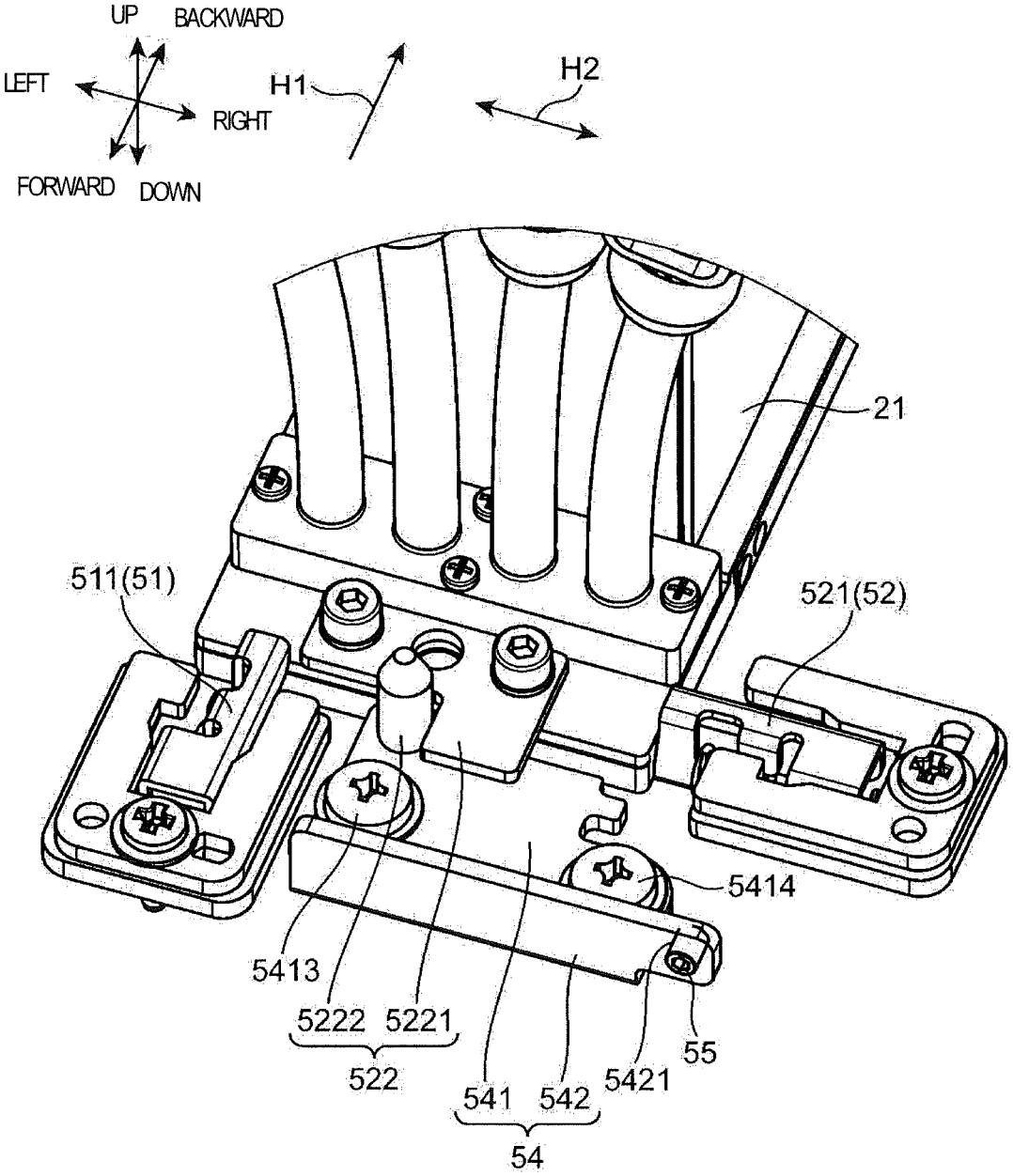
FIG. 24 is an enlarged perspective view showing an area in the vicinity of a turning member and a first screw member in the fixing mechanism included in the image forming apparatus.
Figure 25:
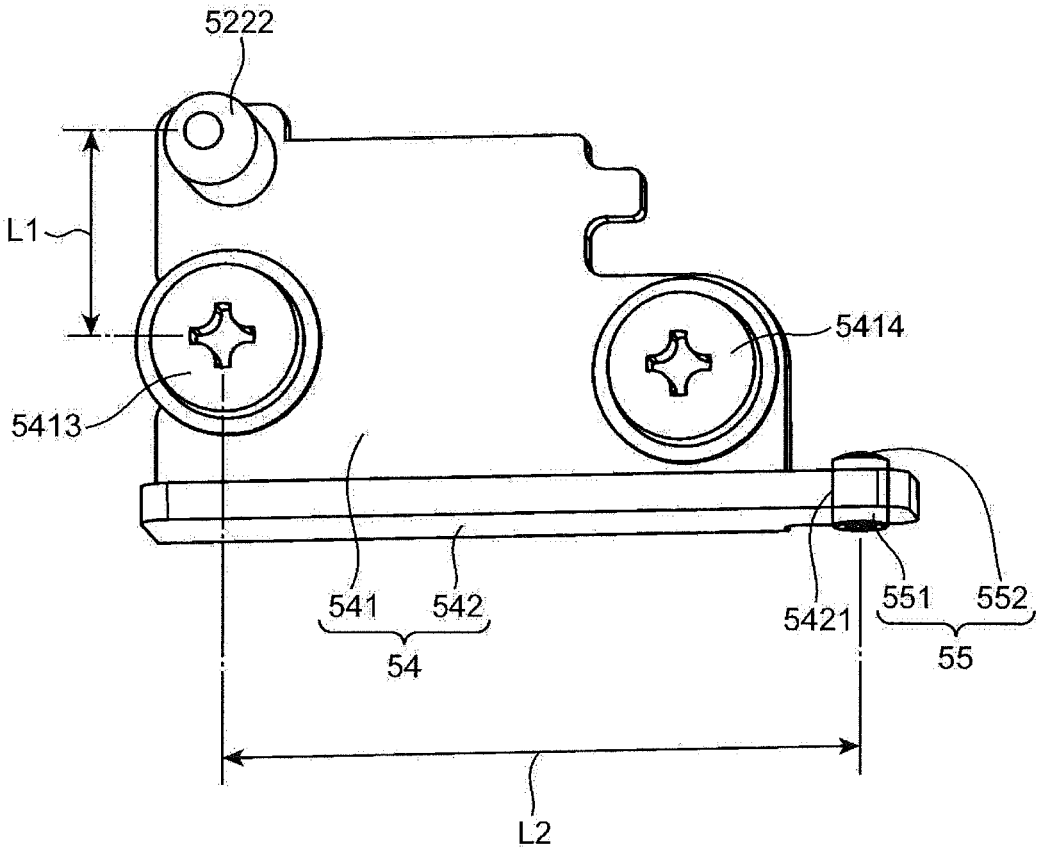
FIG. 25 is a perspective view of the turning member and the first screw member.
Figure 26:
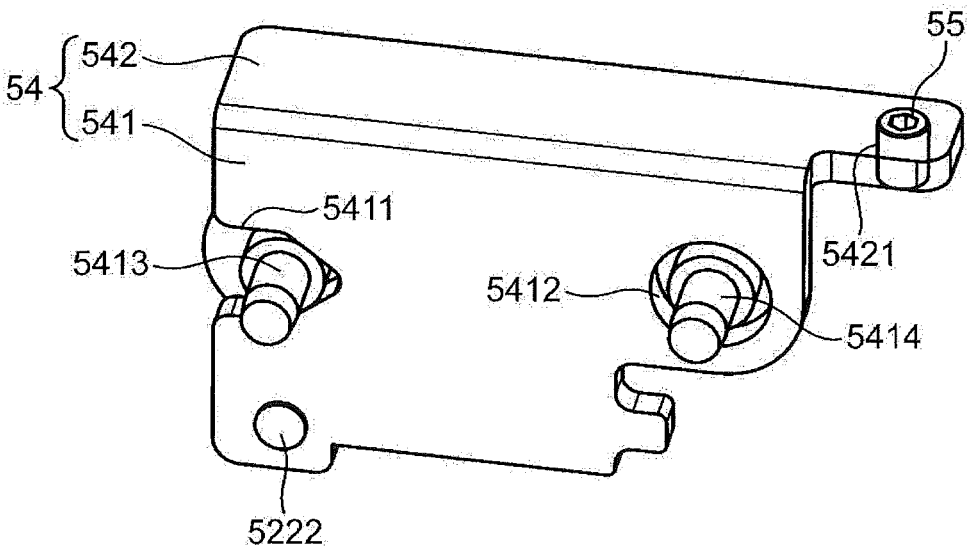
FIG. 26 is a perspective view of the turning member and the first screw member.
Figure 27:
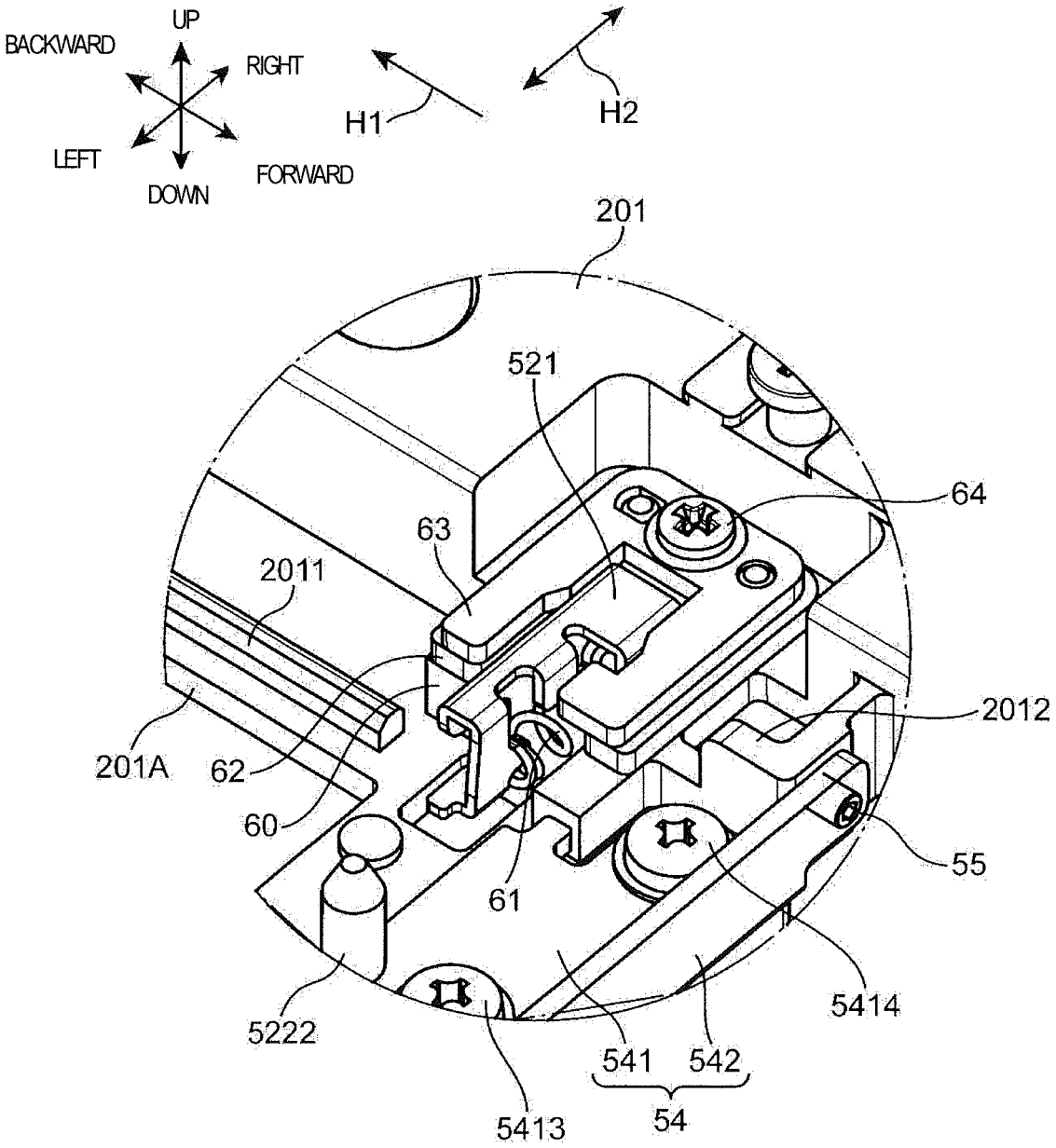
FIG. 27 is an enlarged perspective view showing a positional relationship between a protrusion portion of the lower frame and the first screw member.

The turning member 54 and the first screw member 55 in the fixing mechanism 50 will then be described with reference to FIGS. 24 to 27 in addition to FIGS. 19 to 21. FIG. 24 is an enlarged perspective view showing an area in the vicinity of the turning member 53 and the first screw member 55 in the fixing mechanism 50. FIGS. 25 and 26 are perspective views of the turning member 54 and the first screw member 55. FIG. 27 is an enlarged perspective view showing a positional relationship between a protrusion portion 2012 of the lower frame 201 and the first screw member 55.

The turning member 54 and the first screw member 55 are members for adjusting the position of the head unit 21 in the lower frame 201.

The turning member 54 is arranged on the front side of the opening portion 201A in the end portion (front end portion) of the lower frame 201 on the upstream side in the fitting direction H1, and includes a placement portion 541 and a standing portion 542. The placement portion 541 is part of the turning member 54 which is placed on the lower frame 201, and is formed in the shape of a plate which has predetermined lengths in the width direction H2 (the left/right direction) and a direction (the forward/backward direction) along the fitting direction H1. As shown in FIG. 26, the placement portion 541 includes a cutout portion 5411 which is cut out in a left end edge portion and an insertion hole 5412 which penetrates in a thickness direction (the up/down direction) in a right end portion.

The placement portion 541 is fixed to the lower frame 201 with a first fixing screw 5413 which is inserted through the cutout portion 5411 and a second fixing screw 5414 which is inserted through the insertion hole 5412. The turning member 54 is fixed through the placement portion 541 to the lower frame 201 so as to be able to turn about the first fixing screw 5413 with the first fixing screw 5413 serving as a turning shaft extended in the up/down direction perpendicular to the lower frame 201. Furthermore, in the placement portion 541, the fourth engagement portion 5222 of the second position regulation portion 522 is arranged in a position away from the first fixing screw 5413 serving as the turning fulcrum point of the turning member 54 in the fitting direction H1.

The standing portion 542 is part which is provided on the front end portion of the placement portion 541 of the turning member 54 so as to stand upward, and is formed in the shape of a plate which is extended in the width direction H2 (the left/right direction). In a position of the standing portion 542 away from the first fixing screw 5413 in the width direction H2, specifically, in a right end potion thereof, a first screw hole 5421 is provided which serves as a first location hole along the fitting direction H1.

The first screw member 55 is a screw member which can be screwed into the first screw hole 5421 provided in the standing portion 542 of the turning member 54. The first screw member 55 is an example of a first retractable member which is provided so as to be freely retractable with respect to the first screw hole 5421 serving as the first location hole in a state where the first screw member 55 makes contact with the lower frame 201.

As shown in FIG. 25, the first screw member 55 includes a first screw body portion 551 and a first screw tip end portion 552. The first screw body portion 551 is part in which a screw portion of the first screw member 55 to be screwed into the first screw hole 5421 is provided. The first screw tip end portion 552 is part of the first screw member 55 which is provided on the tip end of the first screw body portion 551, and makes contact with the protrusion portion 2012 (see FIG. 27) which is provided on the lower frame 201 so as to protrude.

The first screw member 55 is rotated about a shaft center by the operator so as to be moved along the fitting direction H1 according to the advance and retreat (retraction) of the first screw body portion 551 with respect to the first screw hole 5421. The first screw member 55 turns the turning member 54 about the first fixing screw 5413 based on the contact force of the first screw tip end portion 552 with the protrusion portion 2012 of the lower frame 201 corresponding to the advance and retreat of the first screw body portion 551 with respect to the first screw hole 5421.

As the turning member 54 is turned, the first screw member 55 moves the fourth engagement portion 5222 arranged on the placement portion 541 so as to change the engagement position of the third engagement portion 5221. In this way, the first screw member 55 makes the head unit 21 swing in the left/right direction with the engagement position of the first engagement portion 5121 and the second engagement portion 5122 serving as the fulcrum point so as to adjust the position of the head unit 21 in the head unit 21.

As described above, in the head unit 21 fitted to the lower frame 201, the position in the fitting direction H1 is regulated by the engagement of the first engagement portion 5121 and the second engagement portion 5122 in the first position regulation portion 512, and the position in the width direction H2 is regulated by the engagement of the third engagement portion 5221 and the fourth engagement portion 5222 in the second position regulation portion 522.

Here, the fourth engagement portion 5222 is arranged on the placement portion 541 of the turning member 54 which can be turned about the first fixing screw 5413 perpendicular to the lower frame 201. In the standing portion 542 of the turning member 54, the first screw hole 5421 along the fitting direction H1 of the head unit 21 is provided. The first screw member 55 is screwed into the first screw hole 5421 of the turning member 54.

The first screw member 55 turns the turning member 54 based on the contact force of the first screw tip end portion 552 with the protrusion portion 2012 provided on the lower frame 201 so as to protrude corresponding to the advance and retreat of the first screw body portion 551 with respect to the first screw hole 5421. As the turning member 54 is turned, the first screw member 55 moves the fourth engagement portion 5222 so as to change the engagement position of the third engagement portion 5221, and thus the first screw member 55 can make the head unit 21 swing with the engagement position of the first engagement portion 5121 and the second engagement portion 5122 serving as the fulcrum point.

In other words, based on the amount of movement corresponding to the advance and retreat of the first screw member 55 with respect to the first screw hole 5421, the amount of movement of the fourth engagement portion 5222 corresponding to the turning of the turning member 54 is set, and the amount of swinging of the head unit 21 with the engagement position of the first engagement portion 5121 and the second engagement portion 5122 serving as the fulcrum point is set. In this way, it is possible to appropriately adjust the position of the head unit 21 with respect to the lower frame 201 based on the amount of movement of the first screw member 55 with respect to the first screw hole 5421.

As shown in FIG. 25, a first adjustment rate (distance L1/distance L2) indicated by a ratio of a distance L1 to a distance L2 is preferably set to a predetermined value which is less than 1. The distance L1 is a distance along the fitting direction H1 between the first fixing screw 5413 serving as the turning fulcrum point of the turning members 54 and the fourth engagement portion 5222. The distance L2 is a distance along the width direction H2 between the first fixing screw 5413 and the first screw member 55 screwed into the first screw hole 5421.

In the configuration described above, a multiplication value obtained by multiplying the amount of movement corresponding to the advance and retreat of the first screw member 55 with respect to the first screw hole 5421 by the first adjustment rate (distance L1/distance L2) is set as the amount of movement of the fourth engagement portion 5222 corresponding to the turning of the turning member 54, that is, the amount of swinging of the head unit 21.

Here, the first adjustment rate (distance L1/distance L2) is set to the predetermined value which is less than 1, and thus the amount of movement of the fourth engagement portion 5222 can be decreased with respect to the amount of movement of the first screw member 55, with the result that the amount of swinging of the head unit 21 can also be decreased with respect to the amount of movement of the first screw member 55. In this way, the position of the head unit 21 with respect to the lower frame 201 can be finely adjusted based on the amount of movement of the first screw member 55 with respect to the first screw hole 5421.

<Configuration of Adjustment Portion>

Figure 28:
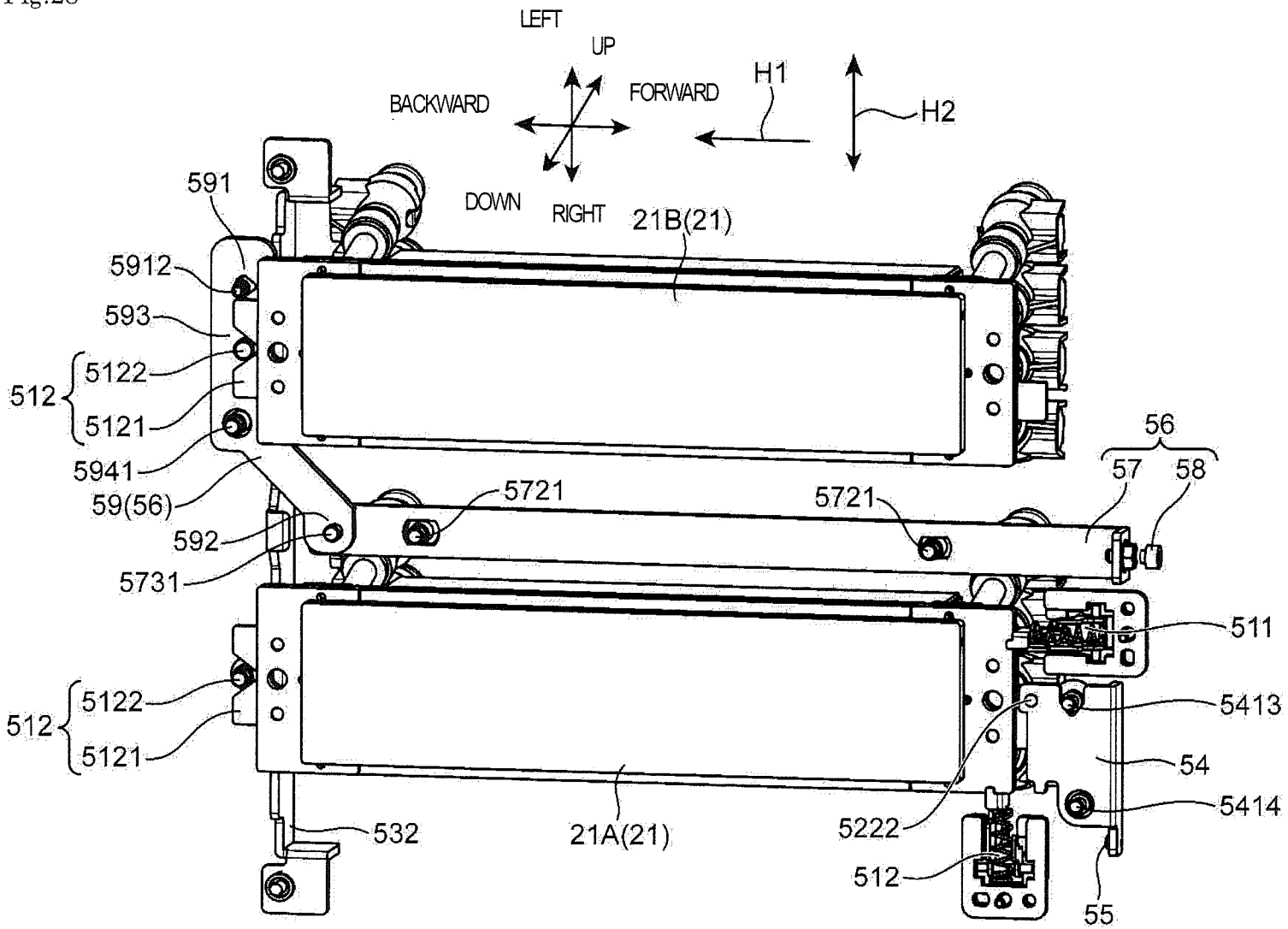
FIG. 28 is a perspective view showing the structure of an adjustment portion in the fixing mechanism included in the image forming apparatus.
Figure 29:
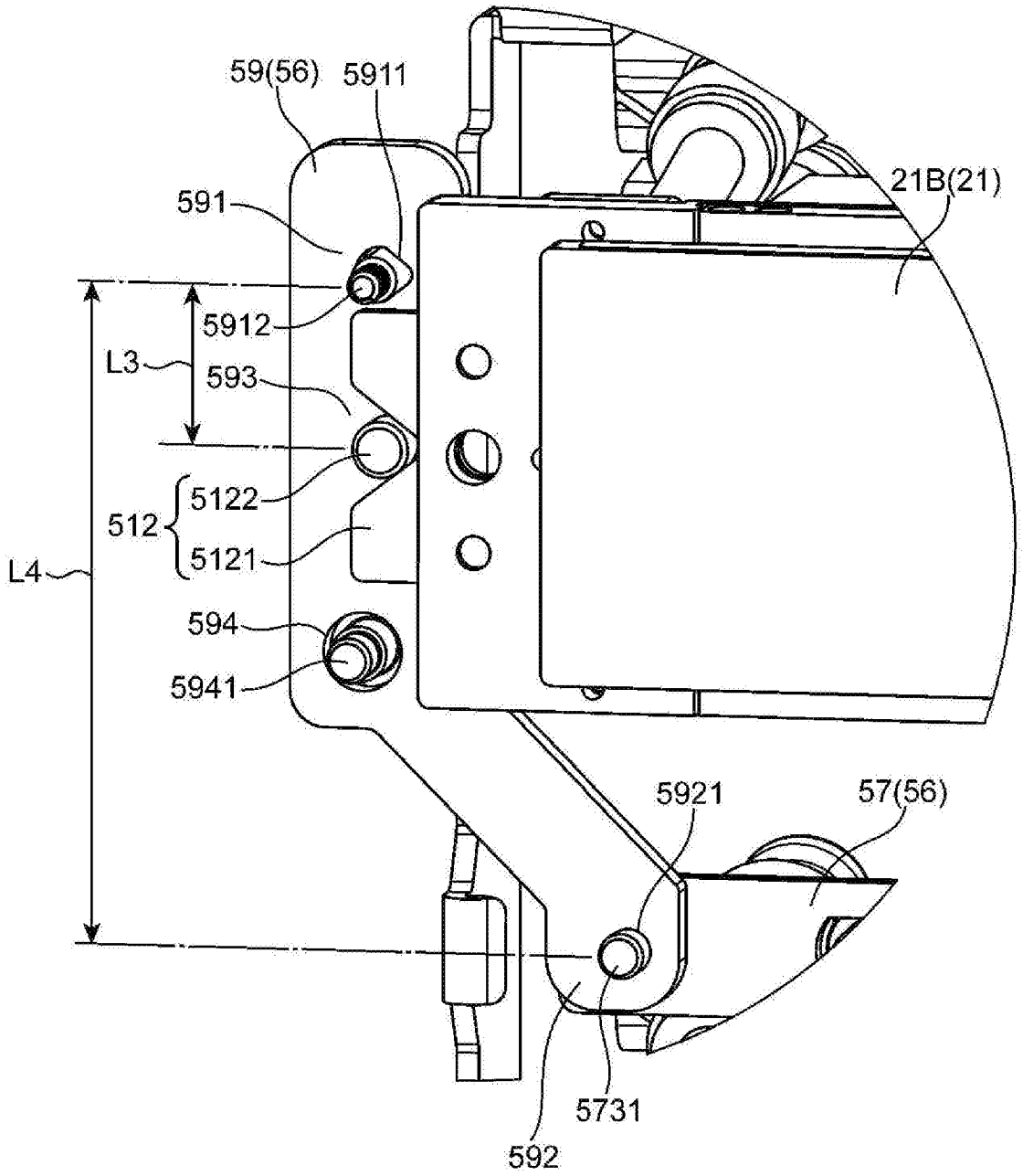
FIG. 29 is an enlarged perspective view showing an area in the vicinity of the link member of the adjustment portion.
Figure 30:
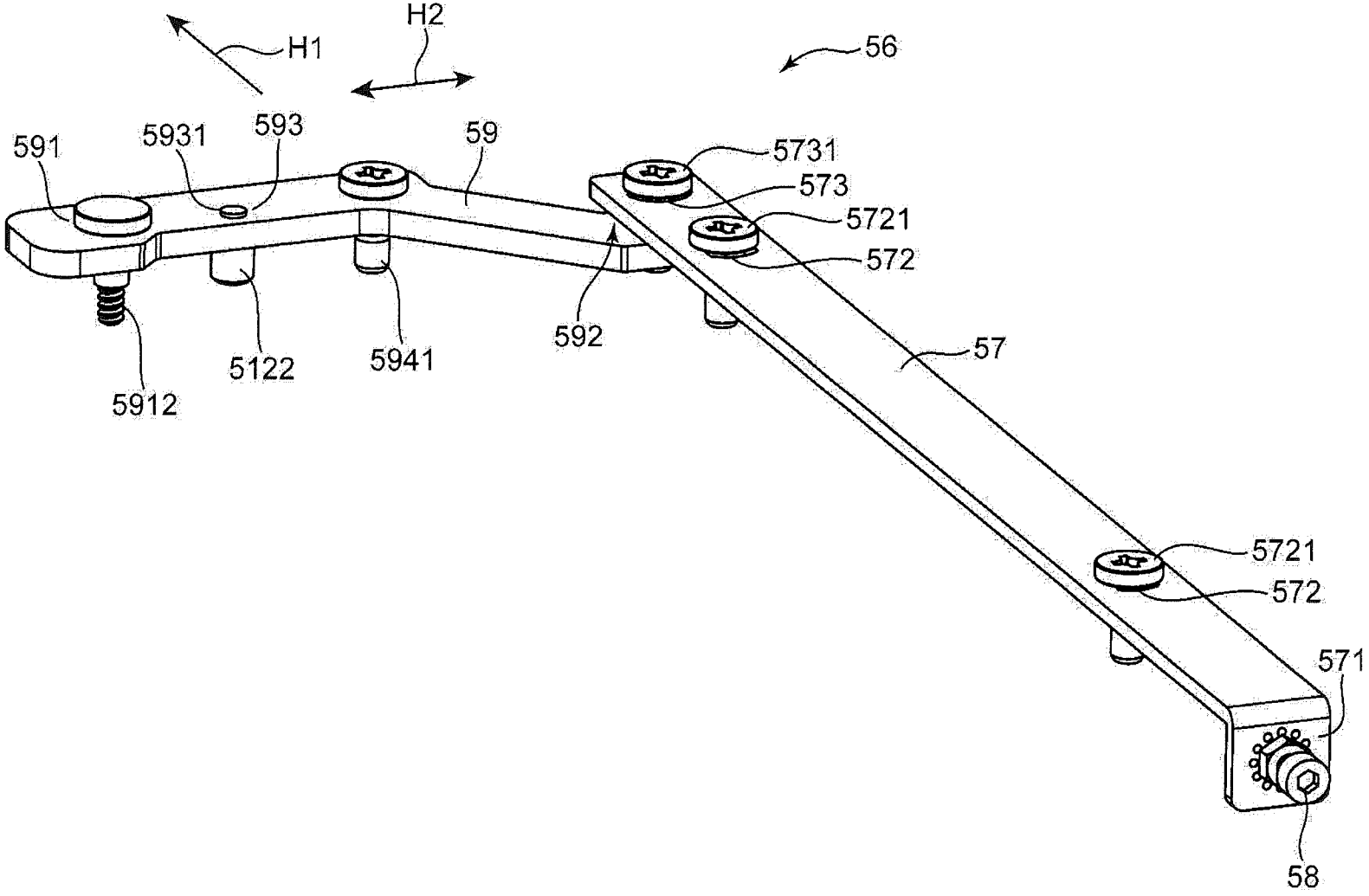
FIG. 30 is a perspective view showing the adjustment portion.
Figure 31:
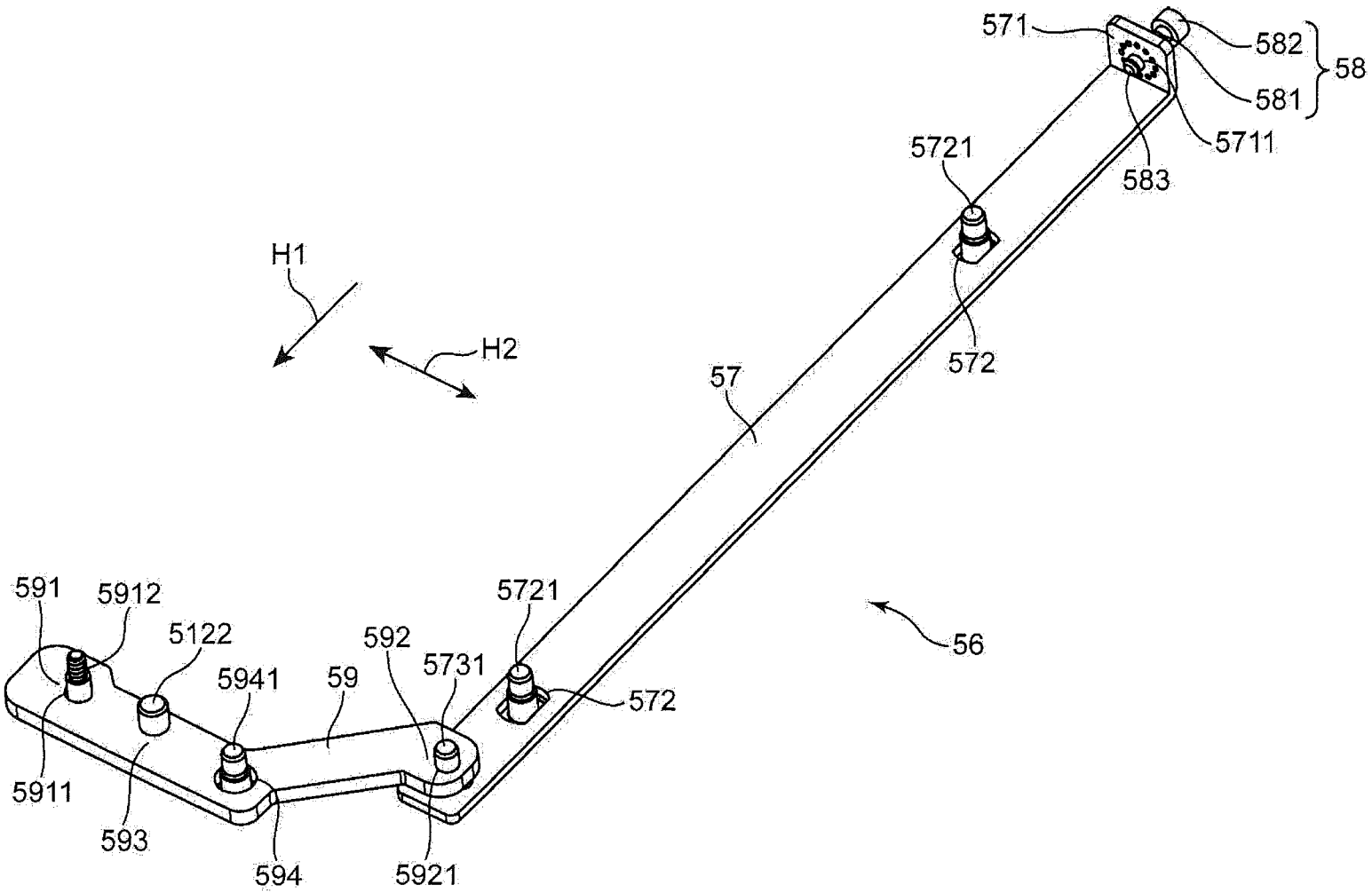
FIG. 31 is a perspective view showing the adjustment portion.
Figure 32:
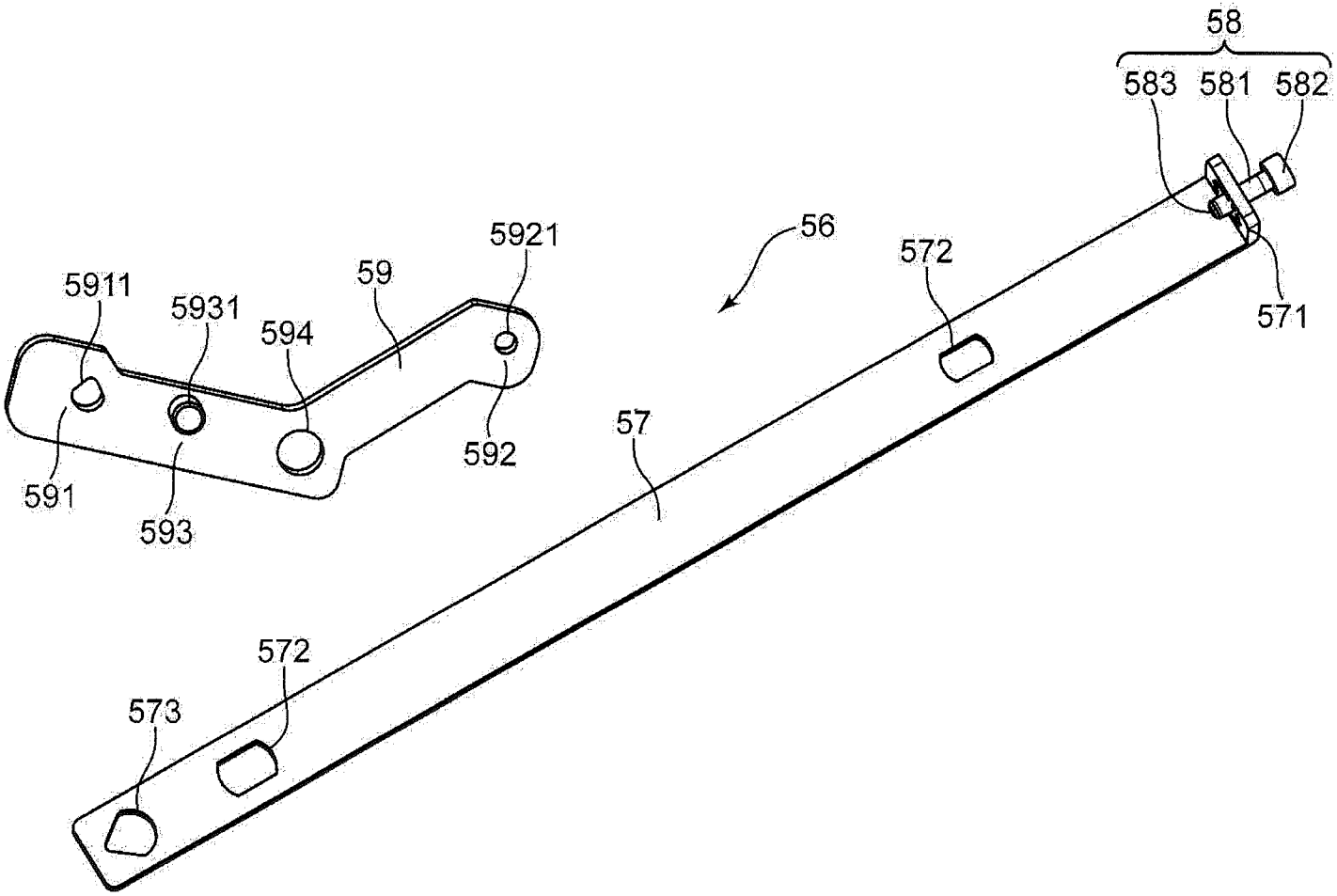
FIG. 32 is an exploded perspective view of the adjustment portion.
Figure 33:
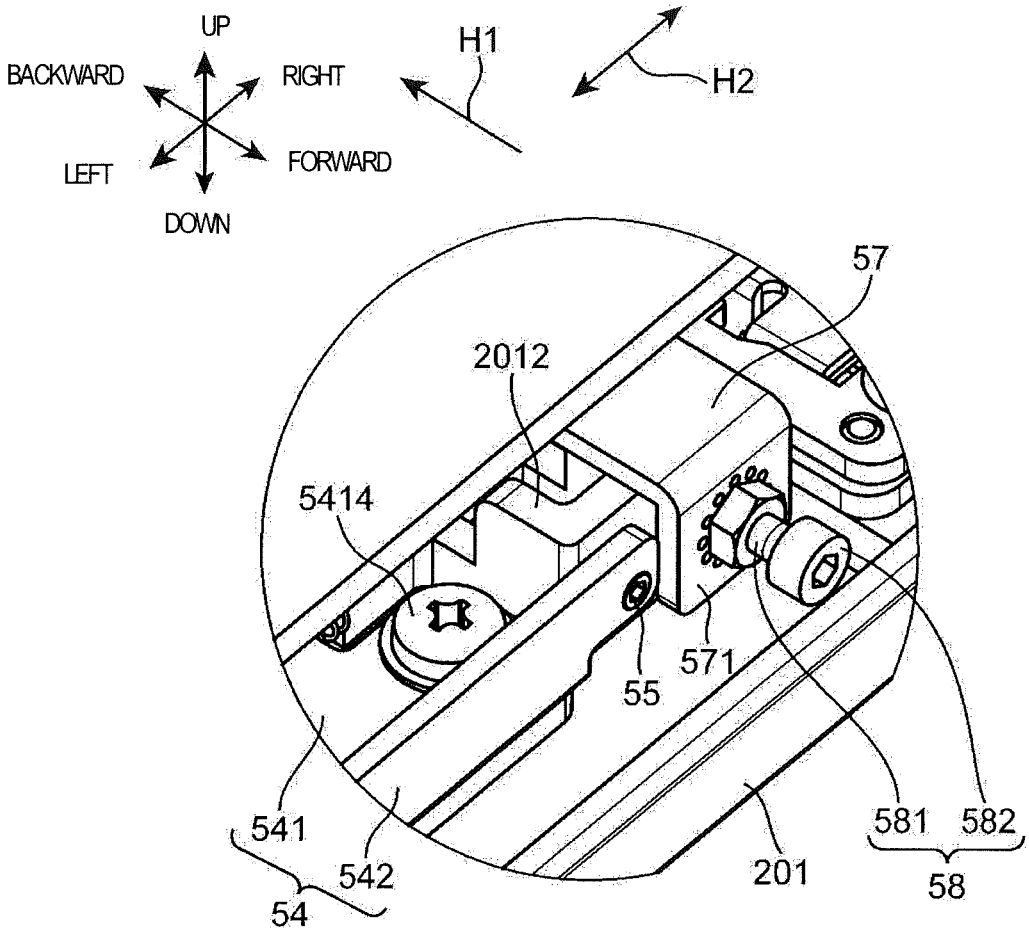
FIG. 33 is an enlarged perspective view showing a positional relationship between the protrusion portion of the lower frame and a second screw member.

The adjustment portion 56 of the fixing mechanism 50 will then be described with reference to FIGS. 28 to 33 in addition to FIG. 19. FIG. 28 is a perspective view showing the structure of the adjustment portion 56 in the fixing mechanism 50. FIG. 29 is an enlarged perspective view showing an area in the vicinity of the link member 59 of the adjustment portion 56. FIGS. 30 and 31 are perspective views showing the adjustment portion 56, and FIG. 32 is an exploded perspective view of the adjustment portion 56. FIG. 33 is an enlarged perspective view showing a positional relationship between the protrusion portion 2012 of the lower frame 201 and a second screw member 58.

The adjustment portion 56 is a structure for adjusting the position of the second head unit 21B with respect to the first head unit 21A in the fitting direction H1 in the two head units 21 formed with the first head unit 21A and the second head unit 21B. The adjustment portion 56 includes a movable member 57, the second screw member 58 and the link member 59.

The movable member 57 is a member in the shape of a bar which is arranged between the first head unit 21A and the second head unit 21B in the lower frame 201 and which is extended along the fitting direction H1. The movable member 57 includes a bent portion 571, an insertion hole 572 and a coupling hole 573. The bent portion 571 is bent to the downward side at an upstream end portion (front end portion) in the fitting direction H1. The insertion hole 572 penetrates an intermediate portion in a thickness direction (the up/down direction) in the fitting direction H1. The coupling hole 573 penetrates, in the thickness direction (the up/down direction), a downstream end portion (back end portion) in the fitting direction H1.

The movable member 57 is fixed to the lower frame 201 with a fixing screw 5721 inserted into the insertion hole 572.

The movable member 57 is fixed to the lower frame 201 so as to be able to move along the fitting direction H1. The movable member 57 is coupled to the link member 59 with a coupling screw 5731 inserted into the coupling hole 573. Furthermore, in the bent portion 571 of the movable member 57, a second screw hole 5711 is provided which serves as a second location hole along the fitting direction H1.

The second screw member 58 is a screw member which can be screwed into the second screw hole 5711 provided in the bent portion 571 of the movable member 57. The second screw member 58 is an example of a second retractable member which is provided so as to be freely retractable with respect to the second screw hole 5711 serving as the second location hole in a state where the second screw member 58 makes contact with the lower frame 201.

As shown in FIGS. 31 and 32, the second screw member 58 includes a second screw body portion 581, a second screw head portion 582 and a second screw tip end portion 583. The second screw body portion 581 is part in which a screw portion of the second screw member 58 to be screwed into the second screw hole 5711 is provided. The second screw head portion 582 is part in which an operation of rotating the second screw member 58 about a shaft center is performed by the operator. The second screw tip end portion 583 is part which is provided at the tip end of the second screw body portion 581 in the second screw member 58, and makes contact with the protrusion portion 2012 (see FIG. 3) which is provided in the lower frame 201 so as to protrude.

The second screw member 58 is rotated about the shaft center through the second screw head portion 582 by the operator so as to be moved along the fitting direction H1 according to the advance and retreat (retraction) of the second screw body portion 581 with respect to the second screw hole 5711. The second screw member 58 moves the movable member 57 along the fitting direction H1 based on the contact force of the second screw tip end portion 583 with the protrusion portion 2012 of the lower frame 201 corresponding to the advance and retreat of the second screw body portion 581 with respect to the second screw hole 5711.

The link member 59 is a member which is coupled through the coupling screw 5731 to a downstream end portion (back end portion) of the movable member 57 in the fitting direction H1, and is arranged on the back side of the opening portion 201A in an end portion (back end portion) of the lower frame 201 on the downstream side in the fitting direction H1.

The link member 59 includes a fulcrum point portion 591, an effort point portion 592 and a load point portion 593. The fulcrum point portion 591 is arranged at one end (left end) in the width direction H2. The effort point portion 592 is arranged at the other end (right end) in the width direction H2. The load point portion 593 is arranged between the fulcrum point portion 591 and the effort point portion 592.

In the fulcrum point portion 591, a fulcrum point insertion hole 5911 is formed which penetrates in a thickness direction (the up/down direction). The fulcrum point portion 591 is fixed to the lower frame 201 with a fulcrum point fixing screw 5912 inserted into the fulcrum point insertion hole 5911.

In the effort point portion 592, an effort point insertion hole 5921 is formed which penetrates in the thickness direction (the up/down direction). The effort point portion 592 is arranged in a position away from the fulcrum point portion 591 in the width direction H2, and is connected to the movable member 57 through the coupling screw 5731 inserted into the effort point insertion hole 5921.

In the load point portion 593, an attachment hole 5931 is formed which penetrates in the thickness direction (the up/down direction). The load point portion 593 is arranged in a position away from the fulcrum point portion 591 in the width direction H2 and between the fulcrum point portion 591 and the effort point portion 592. The second engagement portion 5122 which engages with the first engagement portion 5121 of the second head unit 21B is fixed to the load point portion 593 through the attachment hole 5931.

In the link member 59, between the effort point portion 592 and the load point portion 593, an insertion hole 594 is formed which penetrates in the thickness direction (the up/down direction). The link member 59 is fixed to the lower frame 201 with a fixing screw 5941 inserted into the insertion hole 594. The link member 59 is fixed to the lower frame 201 such that the load point portion 593 swings about the fulcrum point portion 591 based on the movement of the movable member 57 input to the effort point portion 592.

As the load point portion 593 swings, the link member 59 moves the second engagement portion 5122 fixed to the load point portion 593 so as to change the engagement position with the first engagement portion 5121. In this way, the link member 59 moves the second head unit 21B along the fitting direction H1 so as to adjust the position of the second head unit 21B with respect to the first head unit 21A in the fitting direction H1.

As described above, the second screw member 58 is screwed into the second screw hole 5711 of the movable member 57 which can be moved along the fitting direction H1. The second screw member 58 moves the movable member 57 based on the contact force of the second screw tip end portion 583 with the protrusion portion 2012 provided on the lower frame 201 so as to protrude corresponding to the advance and retreat of the second screw body portion 581 with respect to the second screw hole 5711.

The movement of the movable member 57 is input to the effort point portion 592 of the link member 59. The second engagement portion 5122 which engages with the first engagement portion 5121 of the second head unit 21B is fixed to the load point portion 593 of the link member 59. In the link member 59, based on the movement of the movable member 57 input to the effort point portion 592, the load point portion 593 to which the second engagement portion 5122 is fixed swings about the fulcrum point portion 591.

As the load point portion 593 swings, the link member 59 moves the second engagement portion 5122 so as to change the engagement position with the first engagement portion 5121, and thus the second head unit 21B can be moved along the fitting direction H1. In other words, based on the amount of movement corresponding to the advance and retreat of the second screw member 58 with respect to the second screw hole 5711, the amount of movement of the movable member 57 input to the effort point portion 592 of the link member 59 is set.

Furthermore, based on the amount of movement of the movable member 57, the amount of movement of the second engagement portion 5122 corresponding to the swinging of the load point portion 593 about the fulcrum point portion 591 in the link member 59 is set, and the amount of movement of the second head unit 21B with respect to the first head unit 21A along the fitting direction H1 is set. In this way, it is possible to appropriately adjust the position of the second head unit 21B with respect to the first head unit 21A in the fitting direction H1 based on the amount of movement of the second screw member 58 with respect to the second screw hole 5711.

As shown in FIG. 29, in the link member 59, a second adjustment rate (distance L3/distance L4) indicated by a ratio of a distance L3 to a distance L4 is preferably set to a predetermined value which is less than 1. The distance L3 is a distance along the width direction H2 between the fulcrum point portion 591 and the load point portion 593. The distance L4 is a distance along the width direction H2 between the fulcrum point portion 591 and the effort point portion 592.

In the configuration described above, a multiplication value obtained by multiplying the amount of movement corresponding to the advance and retreat of the second screw member 58 with respect to the second screw hole 5711 by the second adjustment rate (distance L3/distance L4) is set as the amount of movement of the second engagement portion 5122 corresponding to the swinging of the load point portion 593 about the fulcrum point portion 591 based on the movement of the movable member 57 input to the effort point portion 592, that is, the amount of movement of the second head unit 21B with respect to the first head unit 21A in the fitting direction H1. Here, the second adjustment rate (distance L3/distance L4) is set to the predetermined value which is less than 1, and thus the amount of movement of the second engagement portion 5122 can be decreased with respect to the amount of movement of the second screw member 58, with the result that the amount of movement of the second head unit 21B along the fitting direction H1 can also be decreased with respect to the amount of movement of the second screw member 58. In this way, the position of the second head unit 21B with respect to the first head unit 21A can be finely adjusted based on the amount of movement of the second screw member 58 with respect to the second screw hole 5711.

What is claimed is:

1. A liquid processing device comprising:

a head unit that jets a liquid to a predetermined workpiece;

a head holding member that includes a fitting portion to which the head unit is fitted and that holds the head unit in a state where the head unit is fitted to the fitting portion; and a fixing mechanism that locates, with respect to the fitting portion, the head unit which is moved to the fitting portion in a predetermined fitting direction so as to be fitted thereto and that fixes the head unit, wherein the fixing mechanism includes:

a turning member which is arranged in the fitting portion so as to be able to turn about a predetermined turning shaft and in which a first location hole along the fitting direction is provided in a position away from the turning shaft in a width direction of the head unit orthogonal to the fitting direction;

a first position regulation portion which includes a first engagement portion that is arranged in the head unit and a second engagement portion that is arranged in the fitting portion and that can engage with the first engagement portion and which regulates a position of the head unit in the fitting portion in the fitting direction by engagement of the first engagement portion and the second engagement portion;

a second position regulation portion which includes a third engagement portion that is arranged in the head unit and a fourth engagement portion that is arranged in a position of the turning member away from the turning shaft in the fitting direction and that can engage with the third engagement portion and which regulates a position of the head unit in the fitting portion in the width direction by engagement of the third engagement portion and the fourth engagement portion; and a first retractable member which is provided so as to be freely retractable with respect to the first location hole of the turning member in a state where the first retractable member makes contact with the fitting portion and which turns the turning member based on a contact force with the fitting portion corresponding to advance and retreat with respect to the first location hole, and the first retractable member moves the fourth engagement portion as the turning member is turned so as to change an engagement position with the third engagement portion, and thereby makes the head unit swing with an engagement position of the first engagement portion and the second engagement portion serving as a fulcrum point so as to adjust the position of the head unit in the fitting portion.

2. The liquid processing device according to claim 1, wherein a first adjustment rate indicated by a ratio of a distance between the turning shaft and the fourth engagement portion along the fitting direction to a distance between the turning shaft and the first location hole along the width direction is set to a predetermined value which is less than 1.

3. The liquid processing device according to claim 1, wherein the head unit includes a first head unit and a second head unit which is adjacent to the first head unit in the width direction and which is fitted to the fitting portion, the turning member, the first position regulation portion, the second position regulation portion and the first retractable member are provided so as to individually correspond to the first head unit and the second head unit, the fixing mechanism further includes an adjustment portion which adjust a position of the second head unit with respect to the first head unit in the fitting direction, the adjustment portion includes:

a movable member in which a second location hole along the fitting direction is provided and which is arranged in the fitting portion so as to be able to move along the fitting direction;

a second retractable member which is provided so as to be freely retractable with respect to the second location hole of the movable member in a state where the second retractable member makes contact with the fitting portion and which moves the movable member based on a contact force with the fitting portion corresponding to advance and retreat with respect to the second location hole; and a link member which includes: a fulcrum point portion that is fixed to the fitting portion; an effort point portion that is arranged in a position away from the fulcrum point portion in the width direction and that is connected to the movable member; and a load point portion that is arranged in a position away from the fulcrum point portion in the width direction and that the second engagement portion engaging with the first engagement portion of the second head unit is fixed to, and in which the load point portion swings about the fulcrum point portion based on the movement of the movable member input to the fulcrum point portion and the link member moves the second engagement portion as the load point portion swings so as to change an engagement position with the first engagement portion, and thereby moves the second head unit along the fitting direction so as to adjust the position of the second head unit with respect to the first head unit in the fitting direction.

4. The liquid processing device according to claim 3, wherein in the link member, a second adjustment rate indicated by a ratio of a distance between the fulcrum point portion and the load point portion along the fitting direction to a distance between the fulcrum point portion and the effort point portion along the width direction is set to a predetermined value which is less than 1.

* * * * *